US006103082A

United States Patent [19]

Ohtsu et al.

[11] Patent Number: 6,103,082

[45] Date of Patent: Aug. 15, 2000

[54] IMAGE FORMING METHOD, IMAGE FORMING APPARATUS AND METHOD FOR MANUFACTURING A COLOR FILTER

[75] Inventors: Shigemi Ohtsu; Satoshi Tatsuura; Eiichi Akutsu; Lyong Sun Pu, all of Nakai-machi, Japan

[73] Assignee: Fuji Xerox Co., Ltd., Tokyo, Japan

[21] Appl. No.: 09/084,094

[22] Filed: May 26, 1998

[30] Foreign Application Priority Data

May 26, 1997 [JP] Japan ..... 9-135410
Jun. 9, 1997 [JP] Japan ..... 9-151349

[51] Int. Cl.[7] ..... C25D 13/00

[52] U.S. Cl. ..... 204/508; 205/317

[58] Field of Search ..... 204/508; 205/317

[56] References Cited

U.S. PATENT DOCUMENTS 3,471,387 10/1969 Lennon et al. ..... 204/508
5,582,700 12/1996 Bryning et al. ..... 204/450

FOREIGN PATENT DOCUMENTS 60-23051 2/1985 Japan .
4-9902 1/1992 Japan .
4-165306 6/1992 Japan .
6-293125 10/1994 Japan .
7-5320 1/1995 Japan .
7-54407 6/1995 Japan .
7-181750 7/1995 Japan .

*Primary Examiner*—Kishor Mayekar
*Attorney, Agent, or Firm*—Oliff & Berridge, PLC

[57] ABSTRACT

A voltage is applied between a first and second electrode, the first electrode being immersed into an aqueous solution in which a group of two or more dyes having different polarities, and including at least one dye able to be independently precipitated from this aqueous solution by an electrochemical reaction, are dissolved and coexist at a specified pH, and the second electrode being provided so as to cooperate with the first electrode in causing the electrochemical reaction, thereby forming a first mixed color image which is composed of the group of dyes, or another mixed color image whose colors are different to those of the first mixed color image and which is composed of the group of dyes, or a single color image which is composed of a single dye on the electrode. Thus, it is possible to realize a high quality image using dyes and safely and simply record an image at a high levels of flexibility. It is also possible to adjust the density of an image easily, and reduce the effects on the environment and energy consumption.

17 Claims, 18 Drawing Sheets

THE CASE OF APPLYING A POSITIVE VOLTAGE INTO AN ELECTRODE

THE CASE OF APPLYING A NEGATIVE VOLTAGE INTO AN ELECTRODE

THE CASE OF APPLYING A POSITIVE VOLTAGE INTO AN ELECTRODE

THE CASE OF APPLYING A NEGATIVE VOLTAGE INTO AN ELECTRODE

IMAGE FORMING METHOD, IMAGE FORMING APPARATUS AND METHOD FOR MANUFACTURING A COLOR FILTER

BACKGROUND OF THE INVENTION

1. Field of the Invention

The present invention relates to an image forming method of using an aqueous liquid containing a dye to deposit the dye electrochemically, thereby forming an image, an image forming apparatus suitable for the image forming method, and a method for manufacturing a color filter using the image forming method.

2. Description of the Related Art

Methods for recording an image onto a recording medium such as paper based on an electric or optical signal, which are currently utilized in printers or the like include the dot impact recording method, the thermal transfer recording method, the thermal sublimation recording method, the ink jet recording method, and the electrophotographic method. These methods are roughly classified into three main groups.

The methods, which are included in the first group are methods of bringing a sheet in which dye molecules are dispersed, such as an ink ribbon or a donor film, into contact with a medium such as paper and then the dye molecules are transferred to the paper by a mechanical impact or heating, and include the dot impact recording method, the thermal transfer recording method, and the thermal sublimation recording method. In these methods, however, consumption articles other than ink and electric power are necessary. Energy efficiency is also low, and running costs are high. Furthermore, apart from the thermal sublimation recording method, the image quality obtained in these methods is poor.

The methods, which are included in the second group, are non-contact methods, and include an ink jet recording method of jetting ink from a ink head onto paper. The ink jet recording method does not require consumption articles other than ink and electric power. However, it is difficult to control the size of the ink dots, the flying direction thereof, or the like completely. Moreover, the ink jet recording method is not high in energy efficiency.

The methods, which are included in the third group, are methods of forming an image on paper via an intermediate transferring member, and include the electrophotographic method, in which toner is adhered onto a latent image on a photosensitive member which is formed by laser spots and then this latent image is transferred onto paper to form an image. In the electrophotographic method, a relatively sharp and fine image can be formed. However, in the electrophotographic method, high voltage is necessary for forming a latent image on the photosensitive member, absorbing the toner by the photosensitive member, and transferring the absorbed toner onto paper. Therefore, there occur problems such as a large amount of power is consumed and ozone and nitrogen oxides are generated.

All of the methods in the first, second and third groups also have the problem that, in general, the noise of the operation of forming an image is quite loud.

Furthermore, a method is known in which a solution, in which a pigment or a dye is dispersed in a polymer having electrodepositing ability, is used to form a electrodeposited film, although it is not as common as the above-mentioned methods.

Those of the methods as disclosed in, for example, Japanese Patent Application Laid-Open (JP-A) No. 60-23051 (Color Printing Apparatus), Japanese Patent Application Laid-Open (JP-A) No. 4-165306 (Method for Making a Color Filter), and Japanese Patent Application Laid-Open (JP-A) No. 7-5320 (Patterning Method, Electrodepositing-Master for Using the Method, and Method for Making a Color Filter And Optical Recording Medium). The electrodeposition film formed in these methods contains a dye which is fixed inside a polymer film as a supporting matrix. The dye content in the ectrodeposition film does not exceed 30%. Therefore, an image having only a low density proportional to the energy consumed energy can be obtained so as to resulting in problems about energy efficiency and cost. Furthermore, in such a method, the same number of dye-applying baths as the number of primary colors used in an additive color method or a subtractive color method are necessary for obtaining a color image or a color filter, and a single electrodeposition step is essential for every primary color.

In view of the above respective properties, an object of the present invention is to provide an image forming method in which a dye can be used to realize high image quality, and in which the density and color of an image can be adjusted, which has excellent safety, is environmentally friendly, and has low energy consumption.

Another object of the present invention is to provide an image forming method which makes the electrodepositing operation for obtaining a color image easier.

Still another object of the present invention is to provide an image forming apparatus using the above-mentioned image forming method.

A further object of the present invention is to provide a method for making a color filter using the above-mentioned image forming method.

SUMMARY OF THE INVENTION

The inventors paid attention to the fact that there are molecules, among water-soluble dye molecules, which can be independently precipitated by an electrochemical reaction from the aqueous solution in which they are dissolved, so as to complete the following present invention.

The first image forming method according to the present invention comprises the step of applying a voltage between a first electrode and a second electrode, the first electrode being immersed into or brought into contact with an aqueous solution in which a group of two or more dyes having same polarities, and including at least one dye which can be independently precipitated from this aqueous solution by an electrochemical reaction, are dissolved and coexist at a specified pH, and the second electrode being provided so as to cooperate with the first electrode in causing the electrochemical reaction, thereby forming on the first electrode a mixed color image which is composed of the group of dyes.

In this method, the dye which can be independently precipitated by an electrochemical reaction from the aqueous solution in which it is dissolved (the dye is referred to as a dye having a electrodeposition film forming ability, hereinafter) is deposited on the first electrode, while incorporating the other dyes, to form on the first electrode a mixed color image.

The dyes are provided in the form of an aqueous solution, and do not have harmful effects on the environment or the human body. Further, consumption articles such as ribbons are unnecessary, except for the dye and electric power. The voltage applied in forming an image is only from about 0.6 to about 3 V, therefore a very small amount of electric power is consumed. Thus, running costs are low. Moreover, a high density, good quality image can be obtained, since the image can contain a large amount of dye. In this method, the density of an image can also be controlled by controlling the voltage between the electrodes or the period of time the voltage is applied.

The second image forming method of the present invention comprises the step of applying voltage between a first and second electrode, the first electrode being immersed into or brought into contact with an aqueous solution in which a group of two or more dyes having different polarities, and including at least one dye which can be independently precipitated from this aqueous solution by an electrochemical reaction, are dissolved and coexist at a specified pH, and the second electrode being provided so as to cooperate with the first electrode in causing the electrochemical reaction, thereby forming, on at least the first electrode, a first mixed-color image composed of the group of dyes, or another mixed-color image composed of the group of dyes and whose colors are different to those of the first mixed-color image, or a single-color image composed of a single dye.

In the second image-forming method, a first mixed-color image, or another mixed-color image whose colors are different to those of the first mixed-color image, or a single-color image, and which is composed of the group of dyes, is formed on at least the first electrode. The specific mechanism of forming the mixed color image is not clear, but it is supposed that it occurs when a dye with one polarity is incorporated into a dye with a different polarity.

According to the second image forming method, it is possible to form an image having two colors from a single type of solution, reduce the steps of forming a color image, and make the operations for forming an image simple. It is also possible to adjust the density or color of an image by controlling the voltage between the electrodes or the period of time the voltage is applied.

The image forming apparatus according to the present invention comprises:

a bath for holding an aqueous solution in which a group of two or more dyes, including at least one dye which can be independently precipitated from this aqueous solution by an electrochemical reaction, are dissolved and coexist at a specified pH, a first electrode which can be immersed into or brought into contact with the aqueous solution, a second electrode provided so as to cooperate with the first electrode in causing the electrochemical reaction, and a voltage applying means for applying voltage between the first and second electrodes.

The apparatus may also comprise a transferring means for transferring the image onto a recording medium.

This image-forming apparatus has the above-mentioned advantages, and makes it possible to form a dye image pattern on the electrode, and if desired, transfer the dye image onto a medium suitable for one's needs so as to form documents.

According to the color filter formation method of the present invention, a color filter can be formed in which an electrodeposited film serving as a single color image or a mixed color image is formed on a transparent electrode serving as the first electrode, using the above-mentioned image forming method.

This method makes it possible to form a color filter, with the above-mentioned advantages. That is, the formation method is greatly simplified in comparison to the prior art.

DESCRIPTION OF THE PREFERRED EMBODIMENTS

The present invention will be explained in detail below.

In the present invention, there is used an aqueous liquid in which a group of two or more dyes are dissolved and coexist at a specific pH value, the dyes including at least one dye which can be independently precipitated from this aqueous solution wherein the dye is dissolved by an electrochemical reaction.

Figure 2:
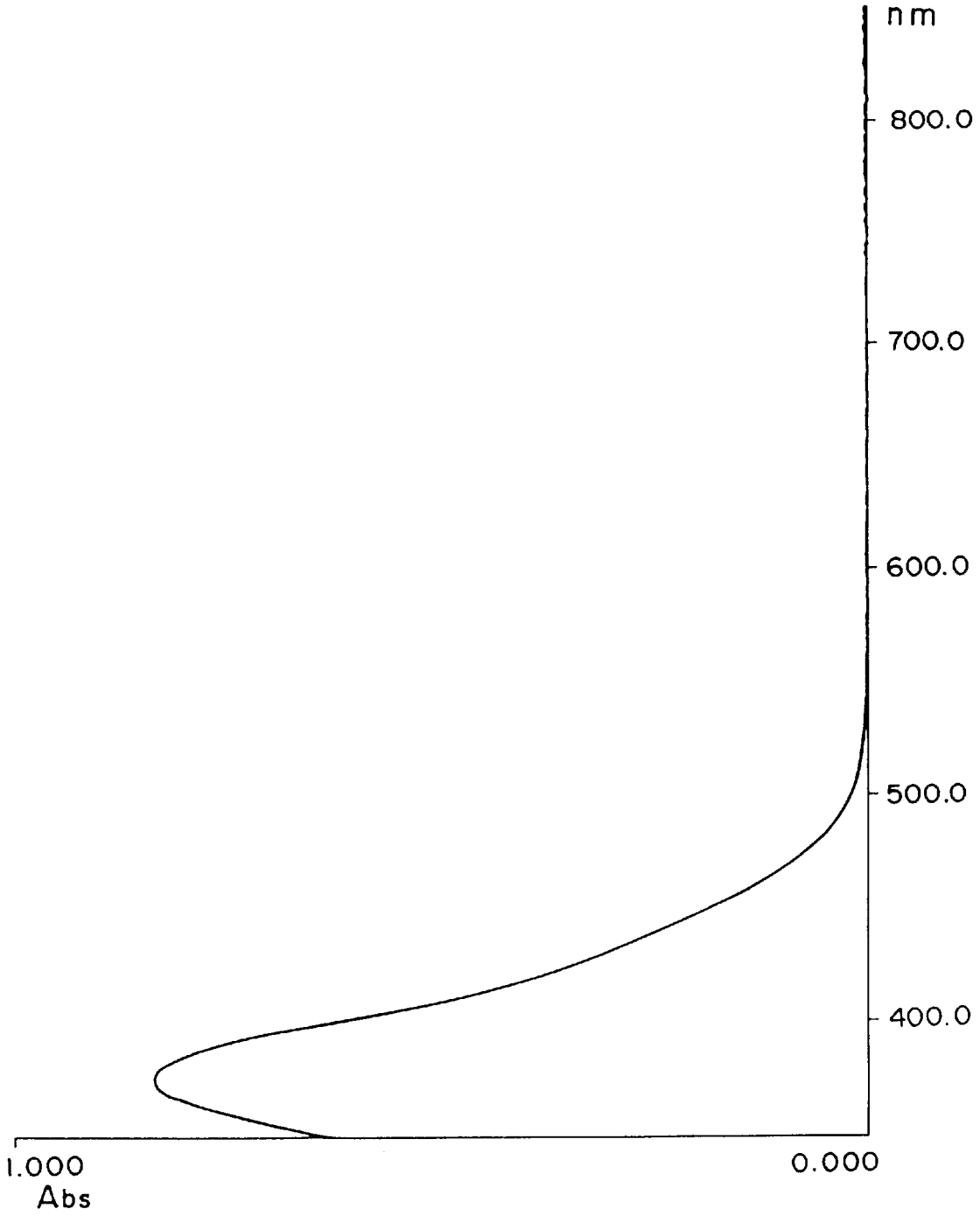
FIG. 2 shows an absorption spectrum of an aqueous solution of Pro Jet Fast Yellow 2, which is an anionic dye used in the present invention.

For example, Rose Bengal and eosin, which are fluorescein type dyes, are water-soluble when the pH is 4 or more, but are oxidized to be water-insoluble and be precipitated when the pH is lower than 4. Similarly, diazo-based, Pro Jet Fast Yellow 2 (manufactured by Zeneca Colours Marking Inc.) is water-soluble when the pH is 6 or more, but is precipitated when the pH is lower than 6. For reference, FIG. 2 shows the absorption spectrum of an aqueous solution of Pro Jet Fast Yellow 2 having a concentration of 20 $\mu$M.

Figure 3:
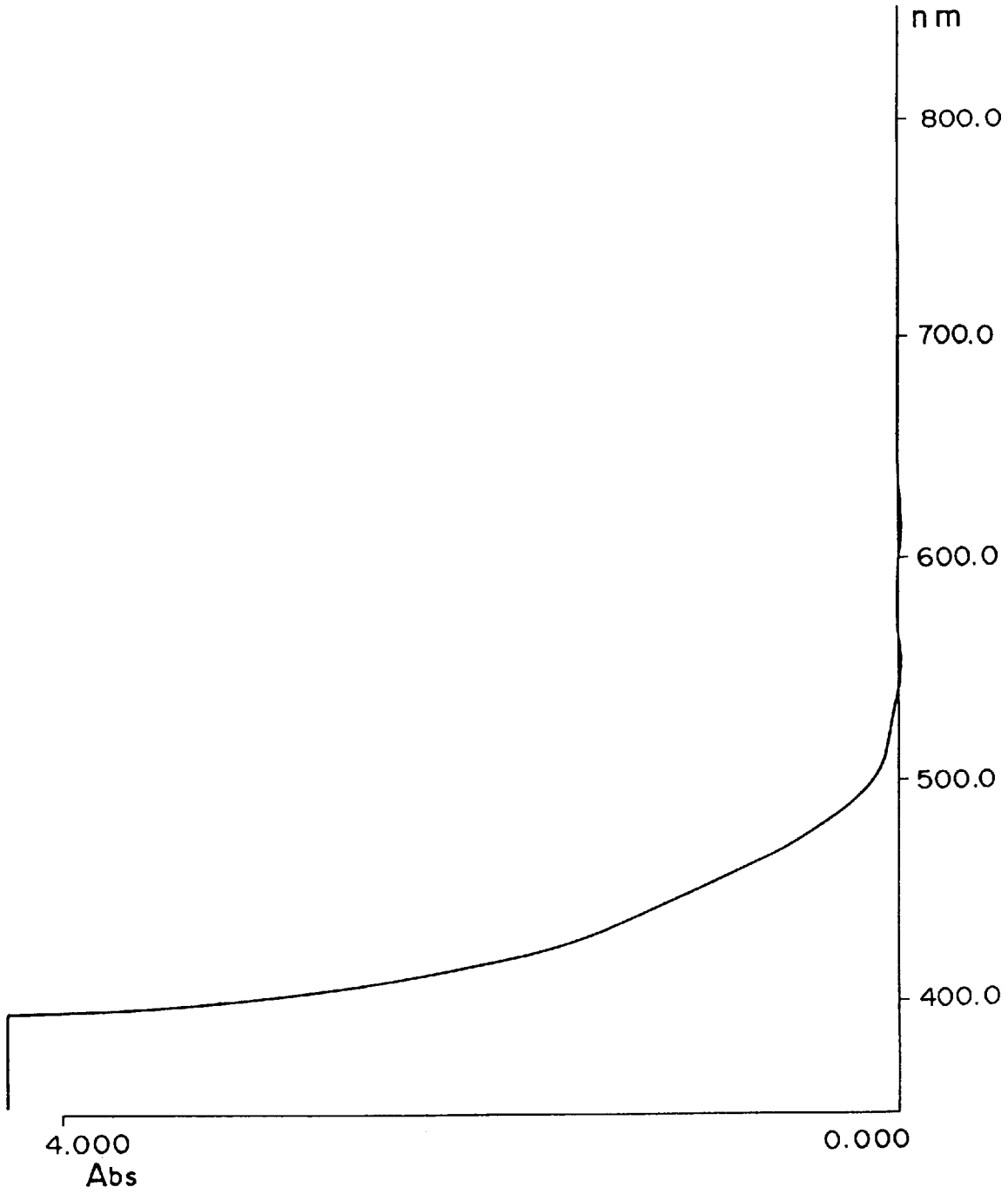
FIG. 3 shows an absorption spectrum of a thin film of Pro Jet Fast Yellow 2, which is an anionic dye used in the present invention.

When a solution, in which such a dye has been dissolved in pure water, is energized (pH 6 to 8), the dye is oxidized to be water-insoluble, thereby forming an electrodeposited film composed of the dye molecules on the anodic electrode. When a voltage is applied between electrodes so that the electrode on which the electrodeposited layer is formed becomes the cathode or when this electrode is immersed into an aqueous solution having a pH of 10 to 12, the dye in the electrodeposited film is reduced to be eluted in the aqueous solution again. For reference, FIG. 3 shows the absorption spectrum of an electrodeposited film of Pro Jet Fast Yellow 2 formed on a transparent electrode of ITO.

Figure 4:
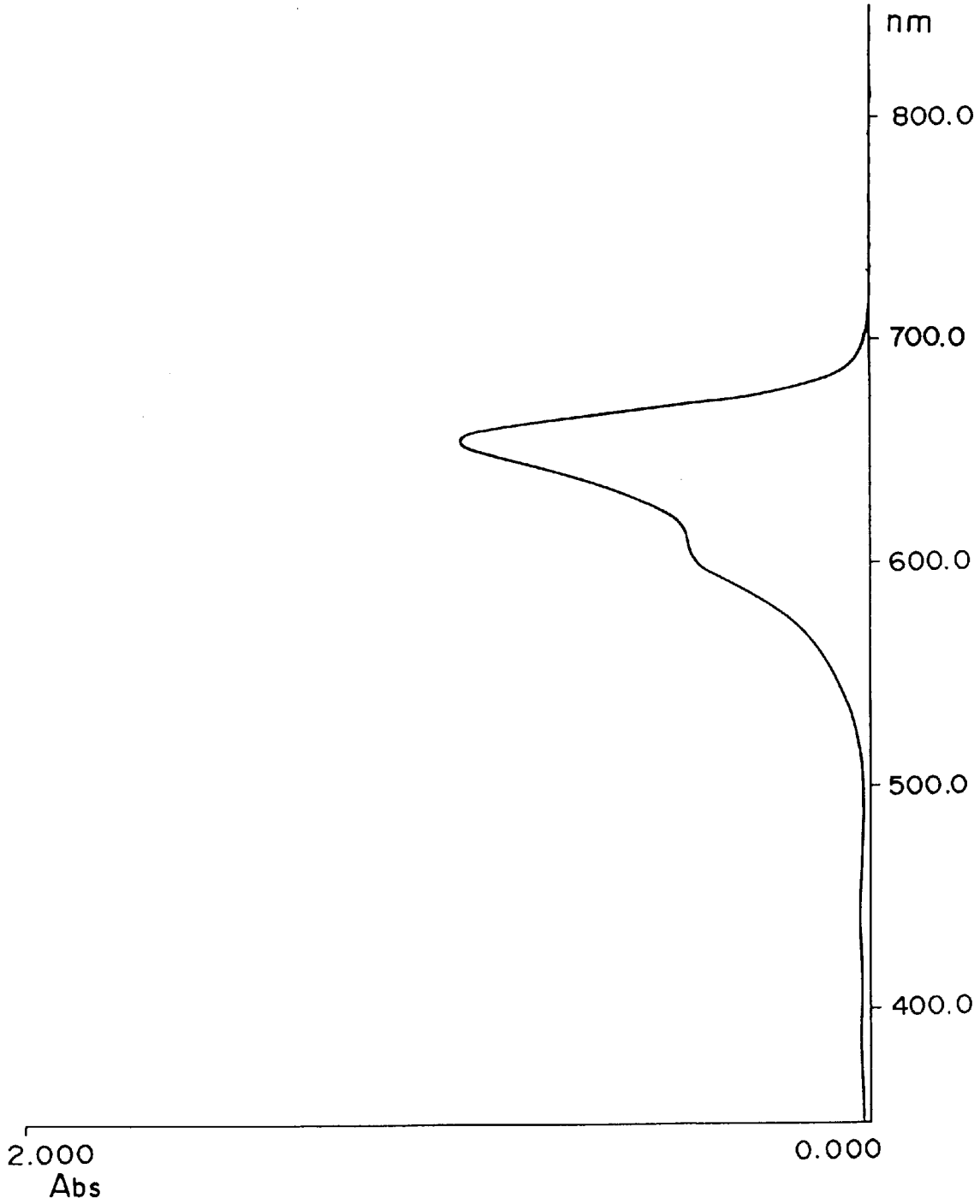
FIG. 4 shows an absorption spectrum of an aqueous solution of Cathilon Pure Blue 5GH, which is a cationic dye used in the present invention.

An oxazine type of basic dye Cathilon Pure Blue 5CH (C.I. Basis Blue 3) [manufactured by Hodogaya Chemical Co., Ltd.], which is a quinoneimine dye, or a thiazine type of basic dye, Methylene Blue (C.I. Basis Blue 9) is water-soluble when the pH is 10 or less, but is reduced to be water-insoluble and precipitated when the pH is higher than 10. Cathilon Pure Blue 5GH is easily dissolved into pure water so as to be present therein as a cation, but is water-insoluble and precipitated when the pH is 11 or more. For reference, FIG. 4 shows the absorption spectrum of an aqueous solution of Cathilon Pure Blue 5GH having a concentration of 20 $\mu$M.

Figure 5:
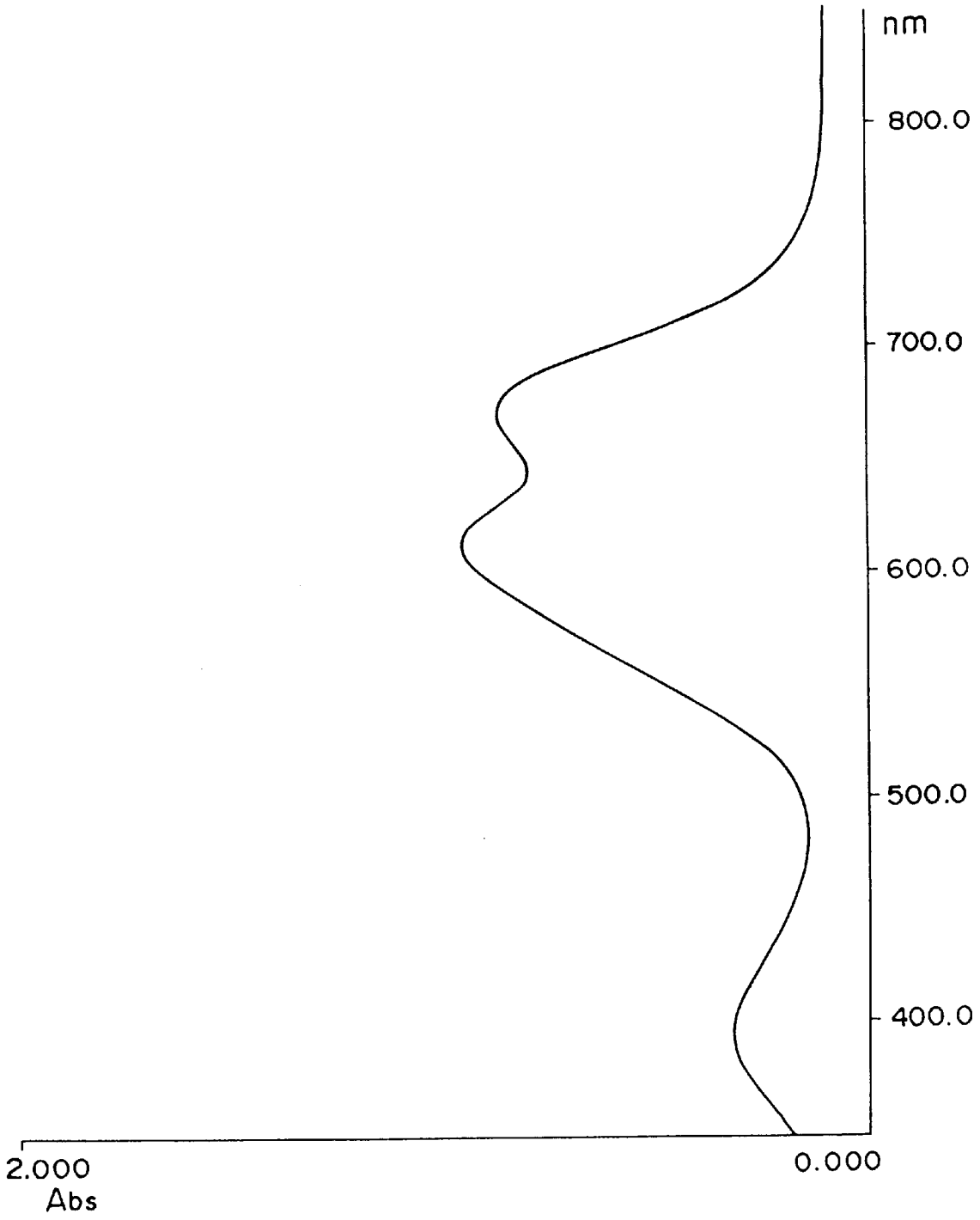
FIG. 5 shows an absorption spectrum of a thin film of Cathilon Pure Blue 5GH, which is a cationic dye used in the present invention.

When such a dye is dissolved in pure water and energized, the dye is reduced to form an electrodeposited film composed of the dye molecules on the cathodic electrode. When a voltage is applied between the electrodes so that the electrode on which the electrodeposited film is formed becomes an anode or when this electrode is immersed into an aqueous solution having a pH of 8 or lower, the dye in the electrodeposited film is oxidized to be eluted in the aqueous solution again. For reference, FIG. 5 shows the absorption spectrum of an electrodeposited film of Cathilon Pure Blue 5GH formed on a transparent electrode of ITO.

As the dye which can be independently precipitated from the aqueous liquid wherein the dye is dissolved, and be used in the present invention (the dye is referred to as a "a dye having electrodeposition film forming ability" hereinafter), there is used a color former which can exhibit a color-developing structure under external stimulation from an acid, a base, and the like. Examples thereof include triphenylmethanephthalide, phenoxazine, phenothiazine, fluoran, indolylphthalide, spiropyran, azaphthalide, diphenylmethane, chromenopyrazole, leucoauramine, azomethine, rhodaminelactam, naphtholactam, and triazene types, more specifically rose Bengal, Pro Jet Fast Yellow 2, and Cathilon Pure Blue 5GH.

The dyes having the chemical structure represented by the general formula (1) have the above-mentioned characteristic.

In the image recording method of the present invention, as the dye which can be independently precipitated from the aqueous solution in which the dye is dissolved, General formula (1):

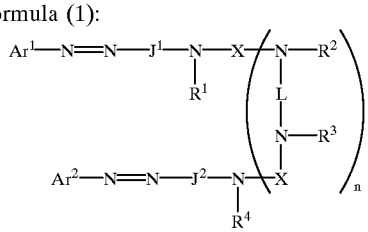

In the general formula (1), $Ar^1$ and $Ar^2$ each independently represent an aryl or substituted aryl group. At least one of $Ar^1$ and $Ar^2$ has at least one substituent selected from a —COSH group and a —COOH group. $J^1$ and $J^2$ each independently represent a group expressed by the formulas (1), (2), or (3) shown below. L represents a bivalent organic linking group. X independently represents a carbonyl group or a group expressed by the formulae (4), (5) or (6). $R^1$ to $R^4$ each independently represent an alkyl or substituted alkyl group. The symbol "n" is 0 or 1.

(1)

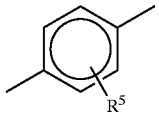

(2)

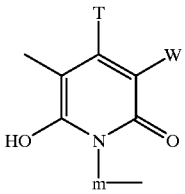

(3)

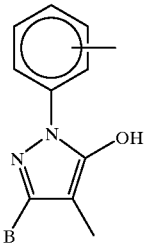

In the formulae (1) to (3), $R^5$ represents a group selected from H, an alkyl group, a substituted alkyl group, an alkoxy group, a halogen atom, —CN, a ureido group, and —$NHCOR^6$ wherein $R^6$ represents H, an alkyl group, a substituted alkyl group, an aryl group, a substituted aryl group, an aralkyl group, or a substituted aralkyl group. T represents an alkyl group. W represents a group selected from the group consisting of H, —CN, —$CONR^{10}R^{11}$, a pyridinium group, and —COOH; m represents an alkylene chain having 2 to 8 carbon atoms; and B represents H, an alkyl group or —COOH, in which $R^{10}$ and $R^{11}$ each independently represent an alkyl or substituted alkyl group.

(4)

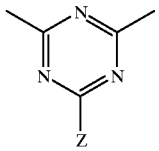

-continued (5)

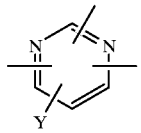

(6)

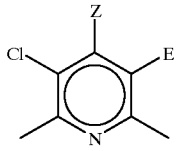

In the formulae (4) to (6), Z represents —$OR^7$, —$SR^7$, or —$NR^8R^9$; Y represents H, Cl, or CN; and E represents Cl or CN, in which each of $R^7$, $R^8$, and $R^9$ represents an alkyl or substituted alkyl group, an alkenyl or substituted alkenyl group, an aryl or substituted aryl group, an aralkyl or substituted aralkyl group, and $R^8$ and $R^9$ may constitute a 5 or 6-membered ring together with a bonded N atom.

Specific examples of the dye represented by the general formula (1) relating to the present invention are shown below, but the dyes which can be used are not limited to the specific examples having the following chemical structures.

Compound (Example-1)

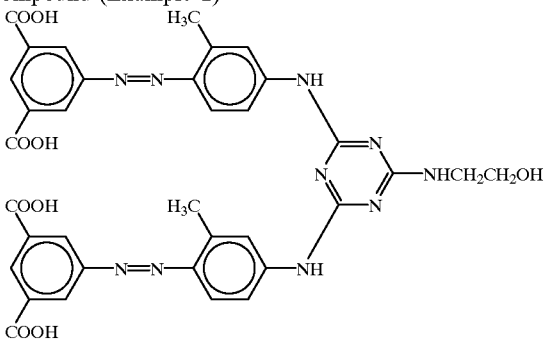

Compound (Example-2)

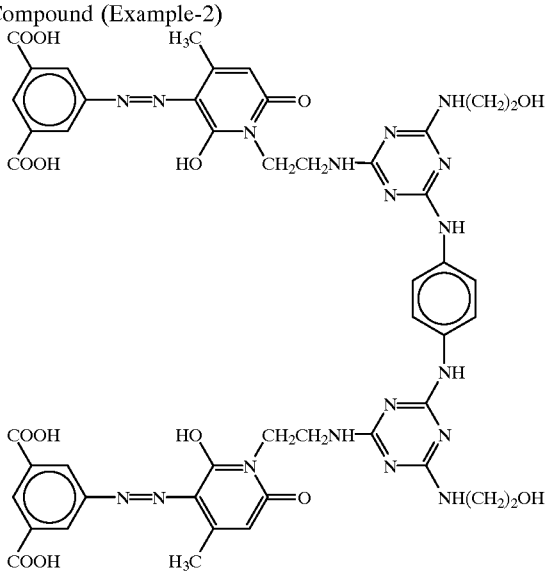

Compound (Example-3)

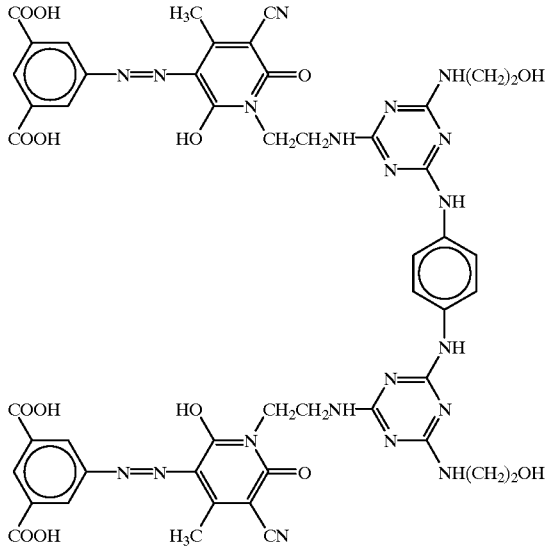

Compound (Example-4)

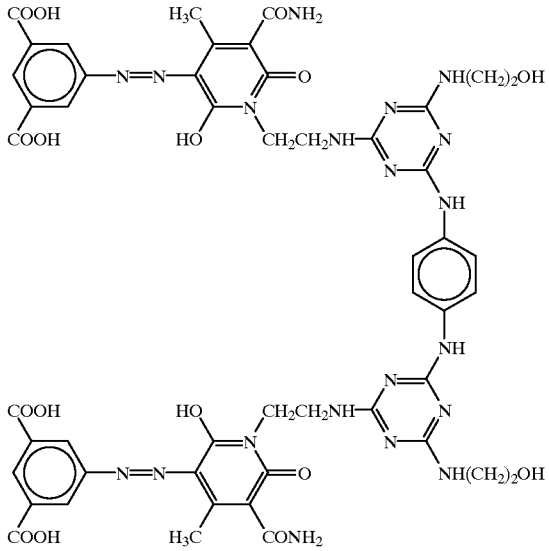

Compound (Example-5)

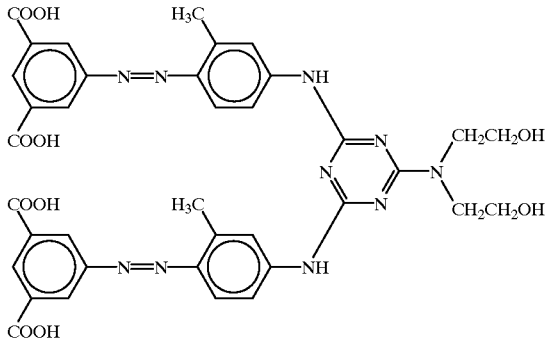

Compound (Example-6)
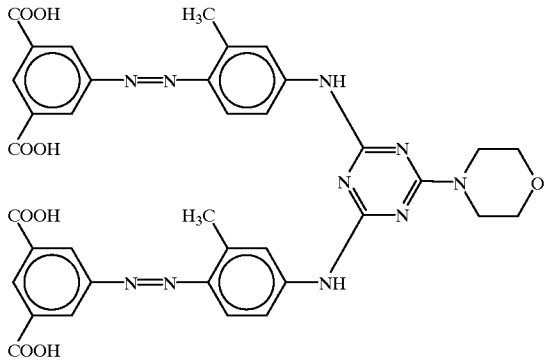
Compound (Example-7)
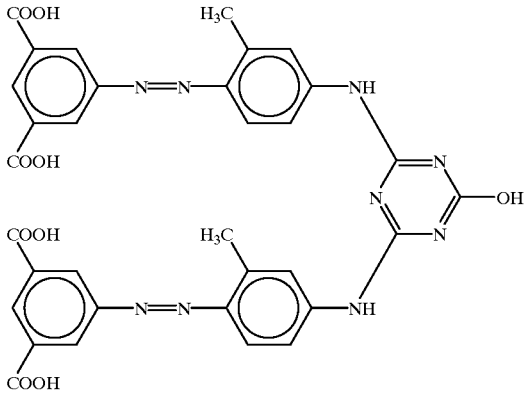
Compound (Example-8)
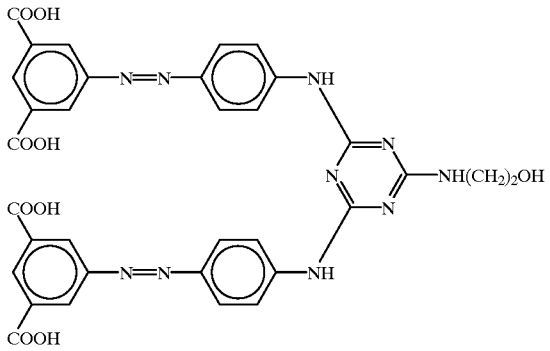
Compound (Example-9)
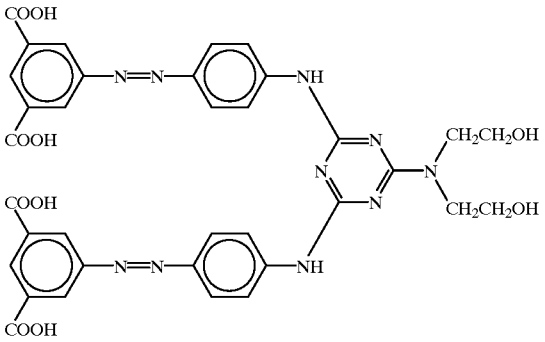
Compound (Example-10)
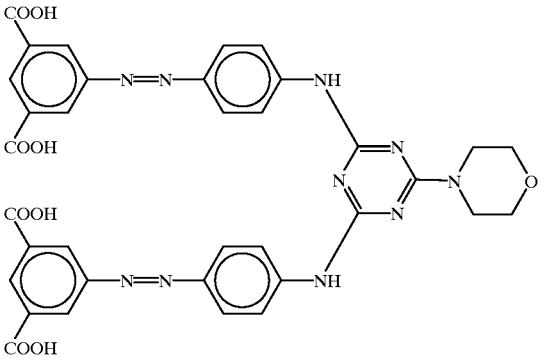
Compound (Example-11)
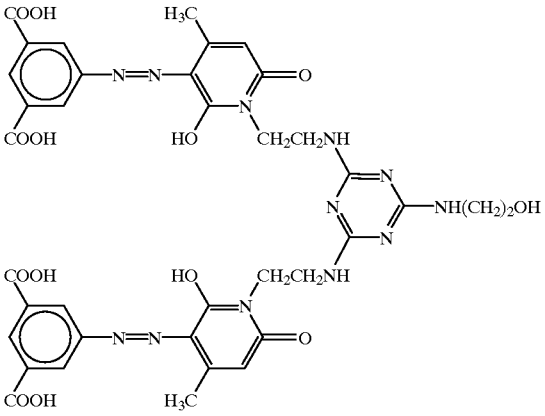

Compound (Example-12)
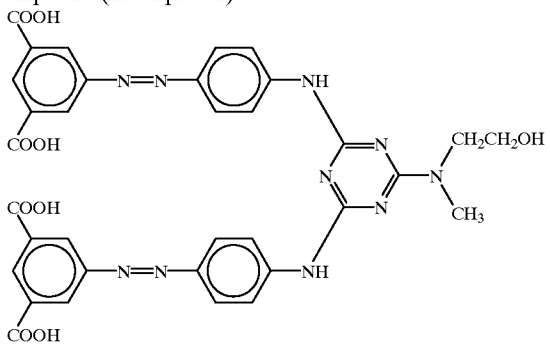
Compound (Example-13)
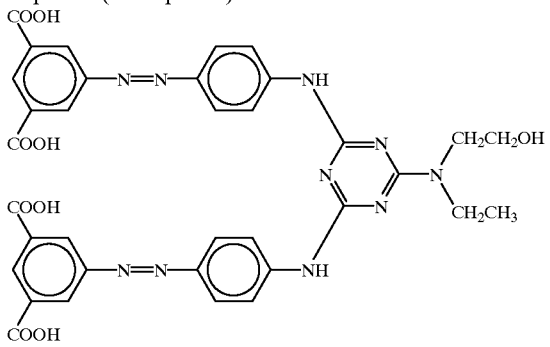
Compound (Example-14)
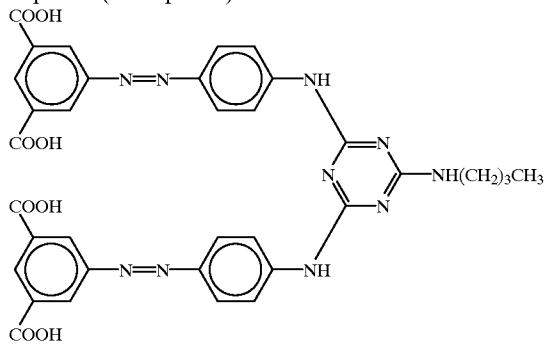
Compound (Example-15)
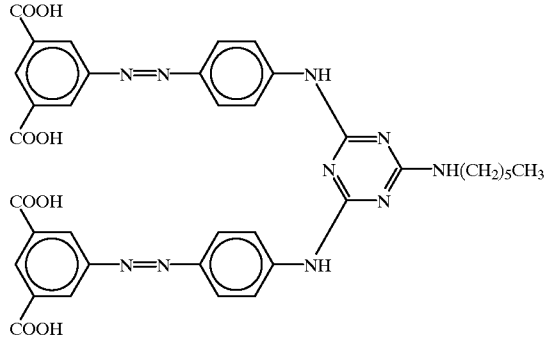
Compound (Example-16)
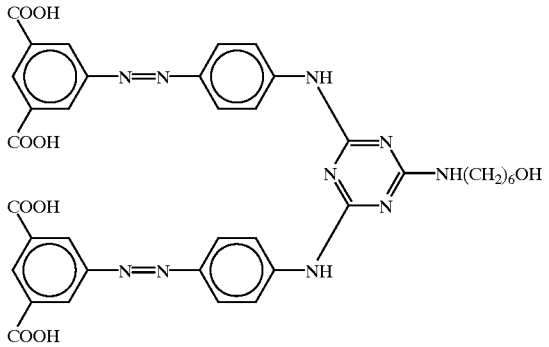
Compound (Example-17)
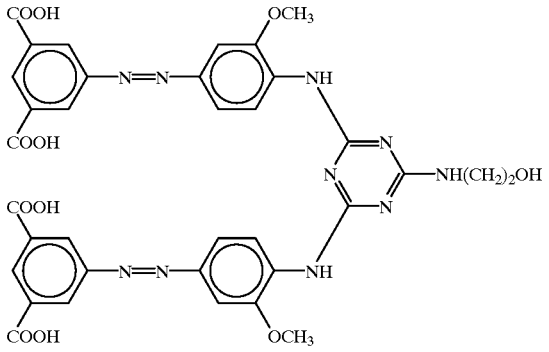
Compound (Example-18)
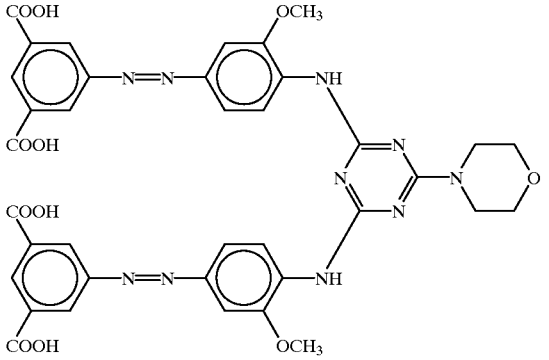

Compound (Example-19)
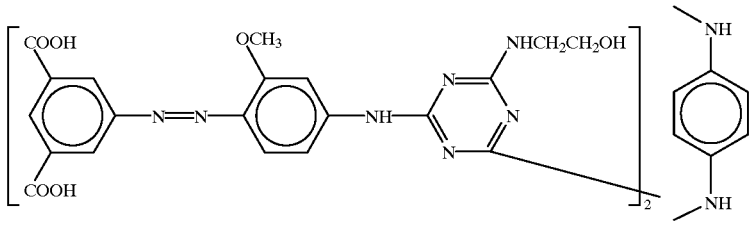
Compound (Example-20)
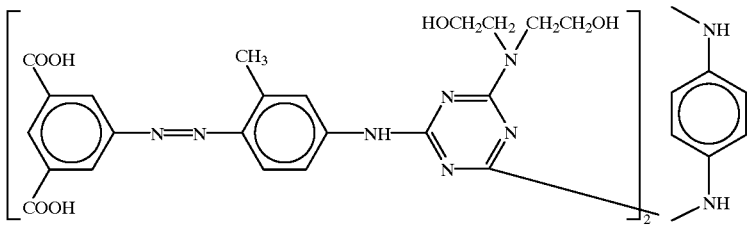
Compound (Example-21)
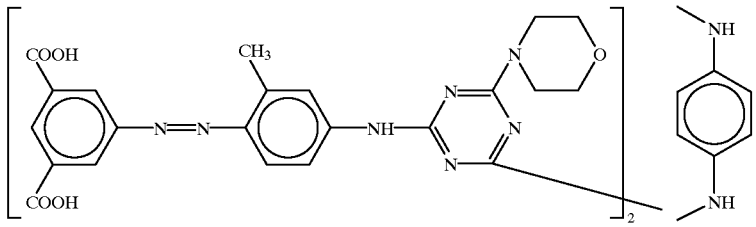
Compound (Example-22)
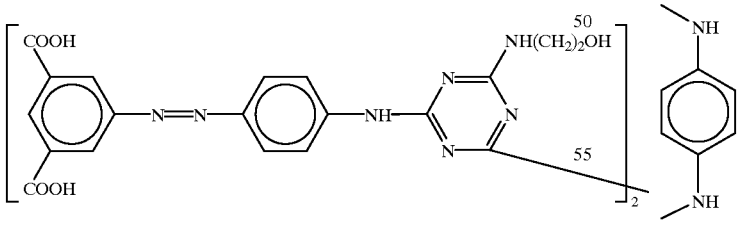

Compound (Example-23)
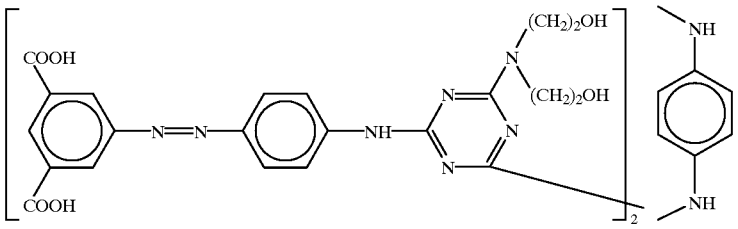
Compound (Example-24)
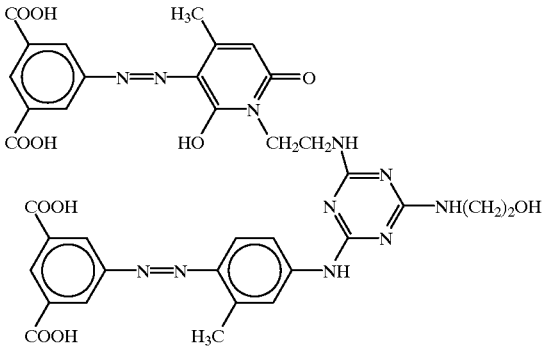
Compound (Example-25)
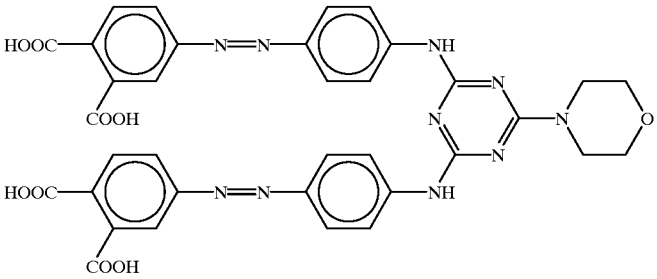
Compound (Example-26)
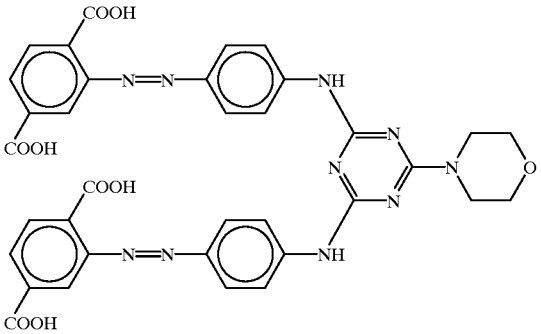
Compound (Example-27)
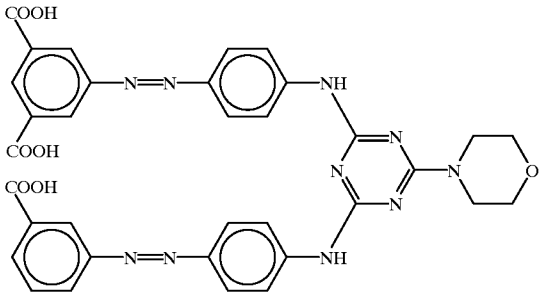

Compound (Example-28)

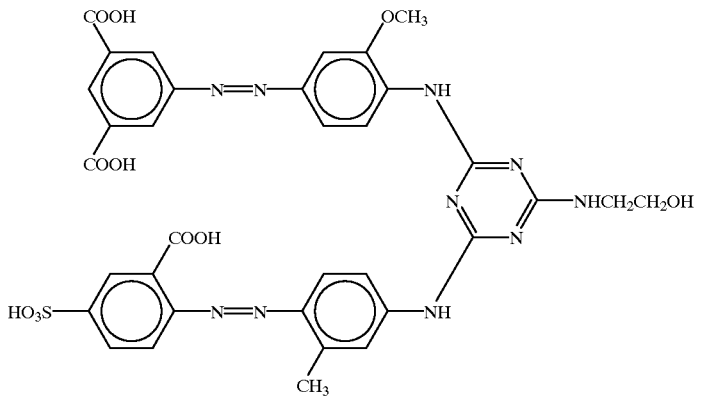

Compound (Example-29)

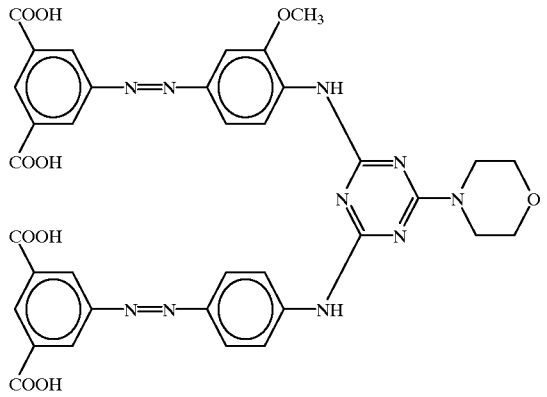

Compound (Example-30)

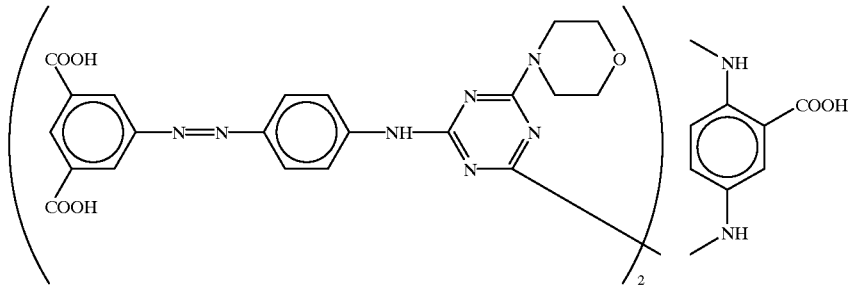

As a dye which has no electrodeposition layer forming ability and may be used together with a dye having a electrodeposition layer forming ability, any ionic dye can be selected. Examples of the ionic dye include acridine, azaphthalide, azine, azulenium, azo, azomethine, aniline, amidinium, alizarin, anthraquinone, isoindoline, indigo, indigoid, indoaniline, indolylphthalide, oxazine, carotenoid, xanthine, quinacridon, quinazoline, quinophthalone, quinoline, quinone, guanidine, chrome chelate, chlorophyll, ketone imine, diazo, cyanine, dioxazine, bisazo, diphenylmethane, diphenylamine, squarilium, spiropyran, thiazine, thioindigo, thiopyrilium, thiofluoran, triallyl methane, trisazotriphenyl methane, triphenly methane, triphenylmethanephthalide, naphthalocyanine, naphthoquinone, naphthol, nitroso, bisazooxadiazole, bisazo, bisazostilbene, bisazohydroxyperinone, bisazofluorenone, bisphenol, bislactone, pyrazolone, phenoxazine, phenothiazine, phthalocyanine, fluoran, fluoren, flugid, perinone, perylene, benzimidazolone, benzopyran, polymethine, porphyrin, methine, merocyanine, monoazo, leucoauramine, leucoxanthine, and rhodamine type synthesized dyes; and natural dyes such as a turmeric, gardenia, red-malt, scallion, grape vine, beet, perilla, berry, corn, cabbage, and cacao.

In the present invention, the pH of the aqueous solution is adjusted so that two or more dyes can coexist without producing a complex or precipitation.

When the dyes contained in the aqueous solution have the same polarity (that is, are all anionic dyes, or cationic dyes), the above-mentioned coexistence can be easily accomplished.

However, when an anionic or cationic dye aqueous solution (e.g., an aqueous solution of anionic Rose Bengal) is mixed with a dye aqueous solution containing a polymer compound (e.g., polyethyleneimine) having a polarity different from the anionic or cationic dye aqueous solution, they are neutralized producing a precipitate. However, since a dye having a electrodeposition film forming ability is used in the present invention to form an image, a polymer compound is not an essential requirement. Dyes having different polarities can also coexist easily in the aqueous solution.

According to the present invention, an aqueous solution in which two or more dyes coexist is energized thus forming an image.

When a mixture solution, in which two dyes having the same polarity are mixed, is energized, an electrodeposited film having the same color as that of the mixture solution is formed on the electrode having the opposite polarity to that of the dyes. When, for example a mixture solution of Rose Bengal (red), which is an anionic dye having a electrodeposition film forming ability, and Brilliant Blue (blue), which is an anionic dye not having this ability, are energized, a purple electrodeposited film, which is the same color as the mixture solution, is formed on the anode. This is because Rose Bengal is oxidized to be deposited on the anode while incorporating the ions of the Brilliant Blue. In such a way as described above, a mixed-color image is generally obtained if dyes having the same polarity are mixed. As understood from this example, it is sufficient if only one dye has the electrodeposition film forming ability when two dyes having the same polarity are mixed.

On the contrary, when a solution, in which two dyes having different polarities are mixed, is energized, different images can be formed dependently according to the polarity of the voltage applied to electrodes.

When dyes having different polarities are used, it depends on the properties of the dyes whether a single-color image is formed or a mixed-color image resulting from the mixed dyes is formed. For this reason, it is important to combine the optimal dyes for forming an image of the desired color.

Figure 6A:
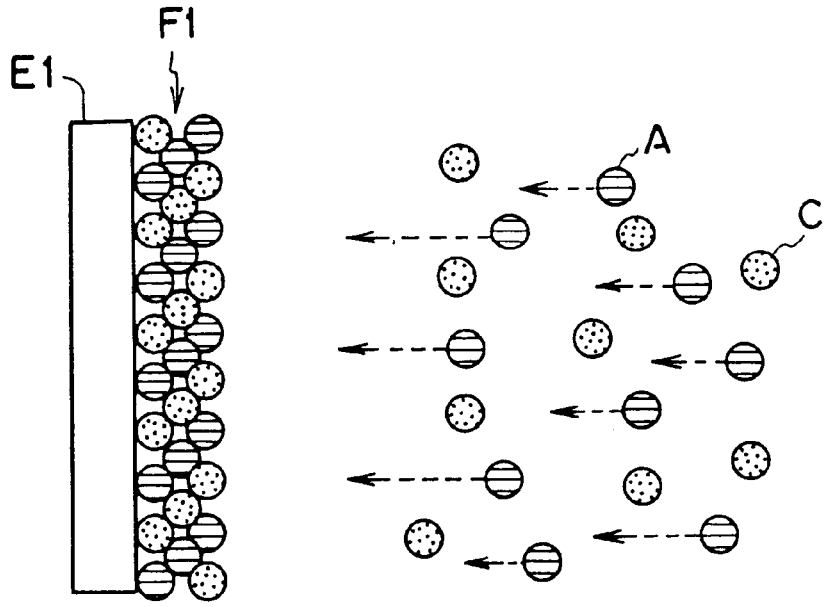
FIGS. 6A and 6B are diagrams explaining the principle of the situation in which different electrodeposited films are formed according to the polarity of the electrodes.
Figure 6B:
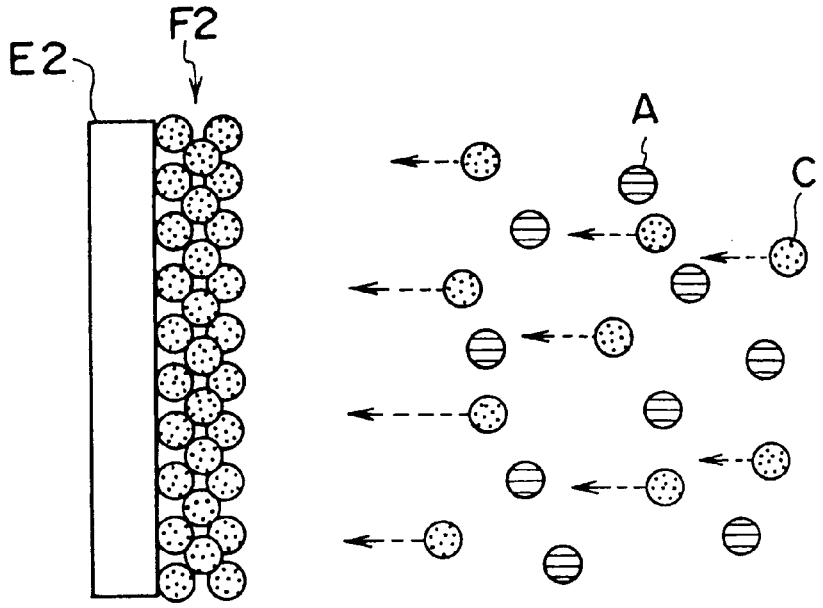

In the case of an aqueous solution in which, for example, Pro Jet Fast Yellow 2 (yellow), which is an anionic dye having the electrodeposition film forming ability, is mixed with Cathilon Pure Blue 5GH (blue), which is a cationic dye having the electrodeposition film forming ability, the color of the solution is green. This is the color resulting from the mixture of these two colors. As shown in FIG. 6A, when this solution is energized, the anionic dye A (Pro Jet Fast Yellow 2) is oxidized to be deposited on an anode E1 while taking in the cationic dye C (Cathilon Pure Blue 5GH), thereby forming an electrodeposited film F1 having the same color (i.e., green) as the mixture solution. On the other hand, as shown in FIG. 6B, a blue electrodeposited film F2 is formed on a cathode E2. This blue color is substantially the same as that of Cathilon Pure Blue 5GH, i.e., the cationic dye C alone (in forming the film, the light yellow results from faded Cathilon Pure Blue 5GH). As understood from this, in the case of a mixture solution containing a mixture of two dyes having the electrodeposition film forming ability and different polarities, this ability of the respective dyes is not lost. When this solution is energized, electrodeposited films having different colors can be formed on the respective electrodes. In this example, at least one of each of the dyes having same polarity has the electrodeposition film forming ability. However, only one of the dyes having either polarity may have the electrodeposition film forming ability.

The amount of dye to be deposited on the electrode changes according to Faraday's law. Therefore, the thickness of the electrodeposited film can be changed successively by controlling at least one of the applied voltage, the applied electric charge, or the applied current in forming a film, or the length of time any one of them is applied. In other words, the density of the electrodeposited film (i.e., the image density) can be changed by controlling, for example, the applied voltage.

Figure 7:
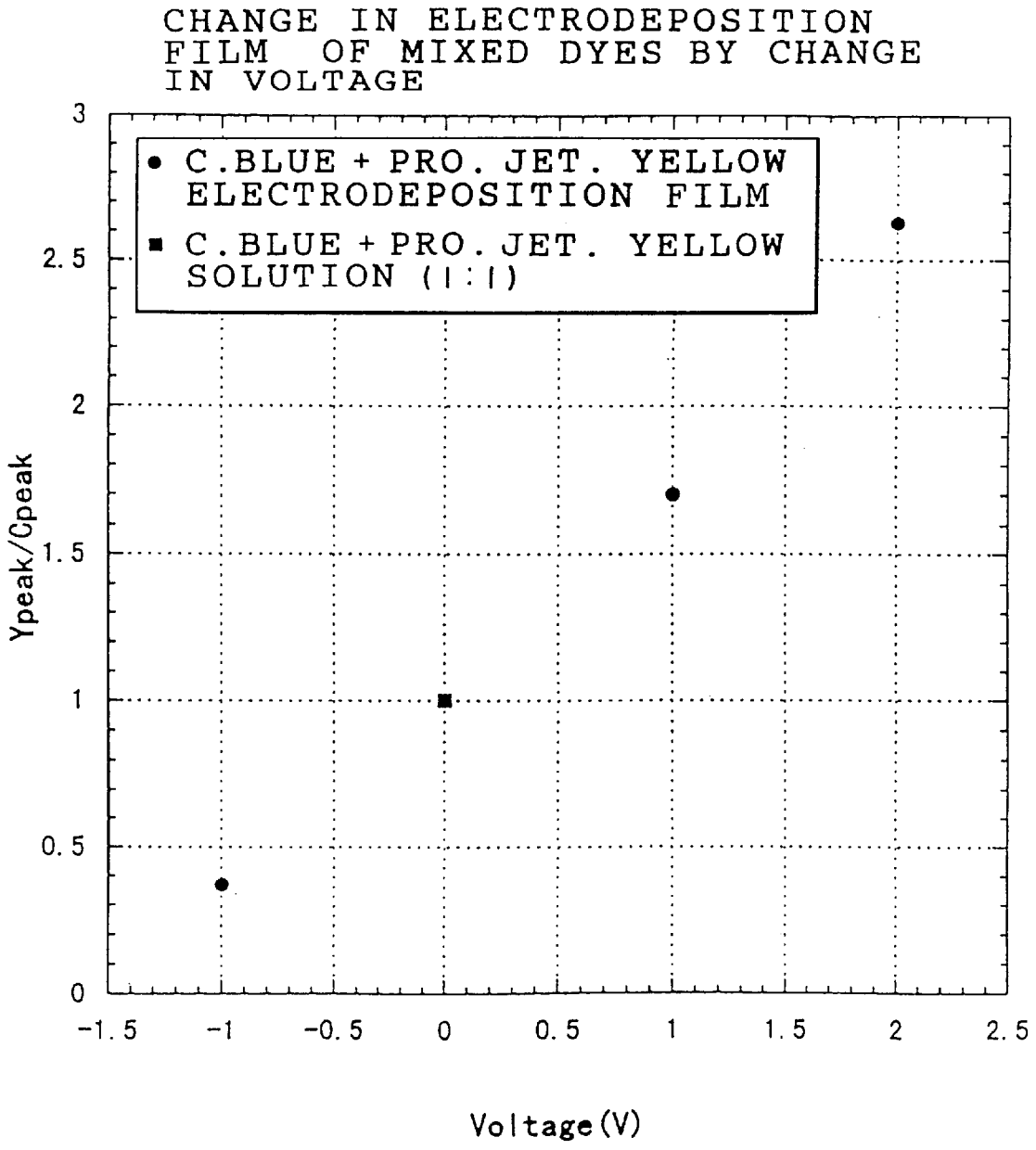
FIG. 7 is a graph showing the relationship between the ratio of Y-peak to C-peak and values/polarities of the voltages applied to the electrodes.
Figure 8:
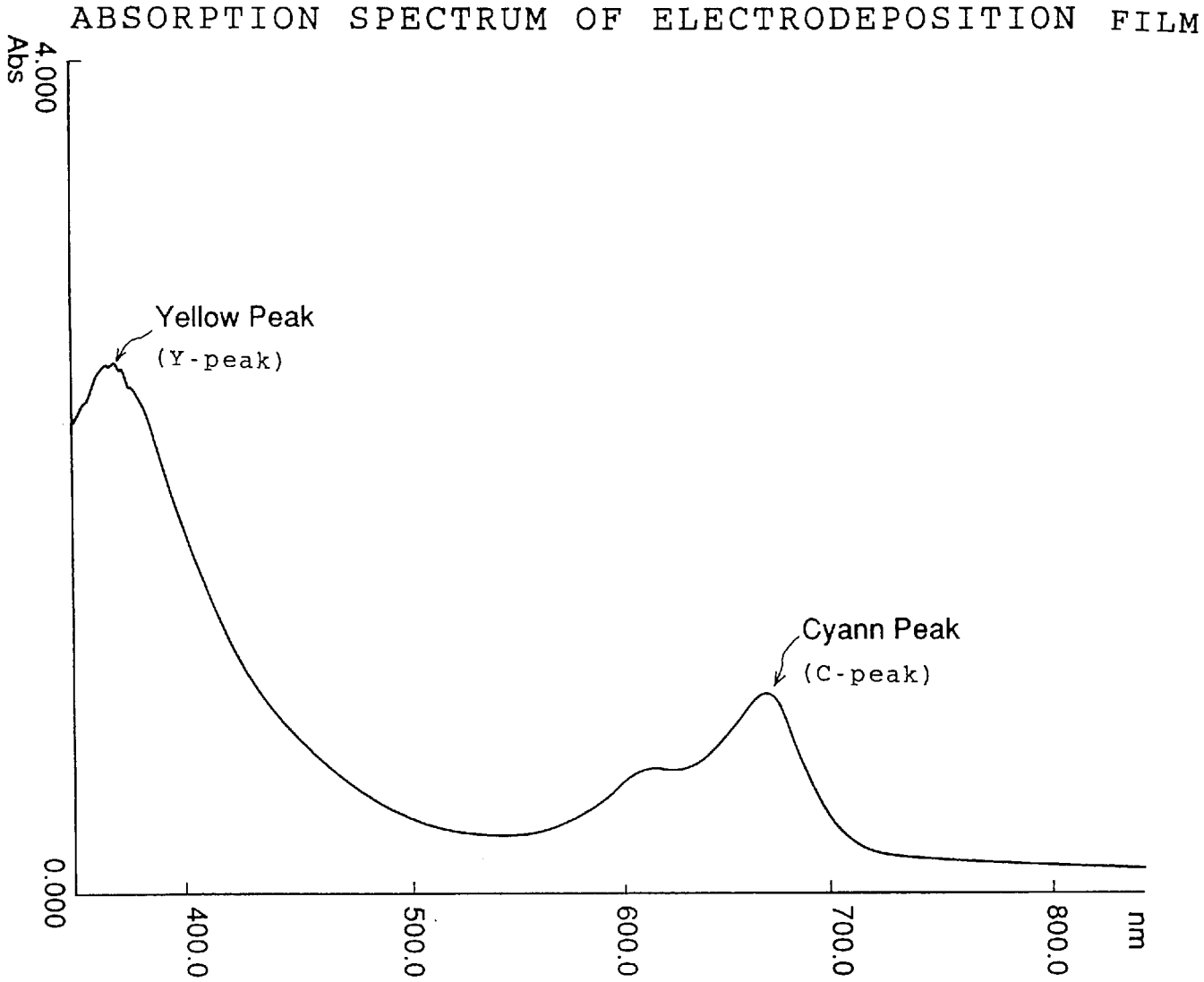
FIG. 8 shows an absorption spectrum of a mixed color film.

In the present invention, the color of the electrodeposited film (i.e., the image color) can be changed by controlling, for example, the applied voltage. FIG. 7 is a graph showing the relationship between the value/polarity of the voltage applied to electrodes and the ratio of the Y-peak (see below) to the C-peak, in the present invention method using a 1:1 mixture solution of Cathilon Pure Blue 5GH and Pro Jet Fast Yellow 2. The Y-peak and the C-peak represent the height of the absorption maximum point in the absorption spectrum of a Pro Jet Fast Yellow 2 electrodeposited film, and that in the absorption spectrum of a Cathilon Pure Blue 5GH electrodeposited film, respectively (see FIG. 7). FIG. 7 demonstrates that the ratio of the Y-peak to the C-peak, that is, the color of the electrodeposited film can be changed by changing the value and the polarity of the voltage applied to the electrodes.

In the present invention, the total concentration of dyes in a solution is usually from 0.1 mM to 1 M. The percentage of each of the dyes is not limited. In the case where a dye which does not have the electrodeposition film forming ability is included, the ratio of this dye to the dye having the ability may be, for example, from 1/99 to 10/1.

Figure 1:
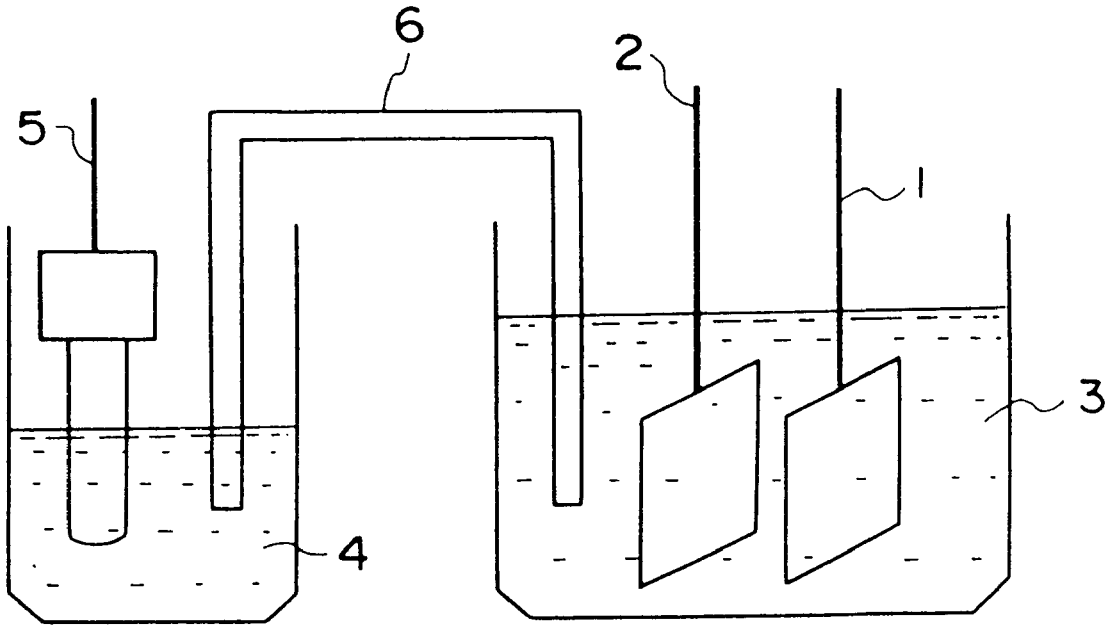
FIG. 1 is a schematic structured diagram of an apparatus used in the present invention.
Figure 9:
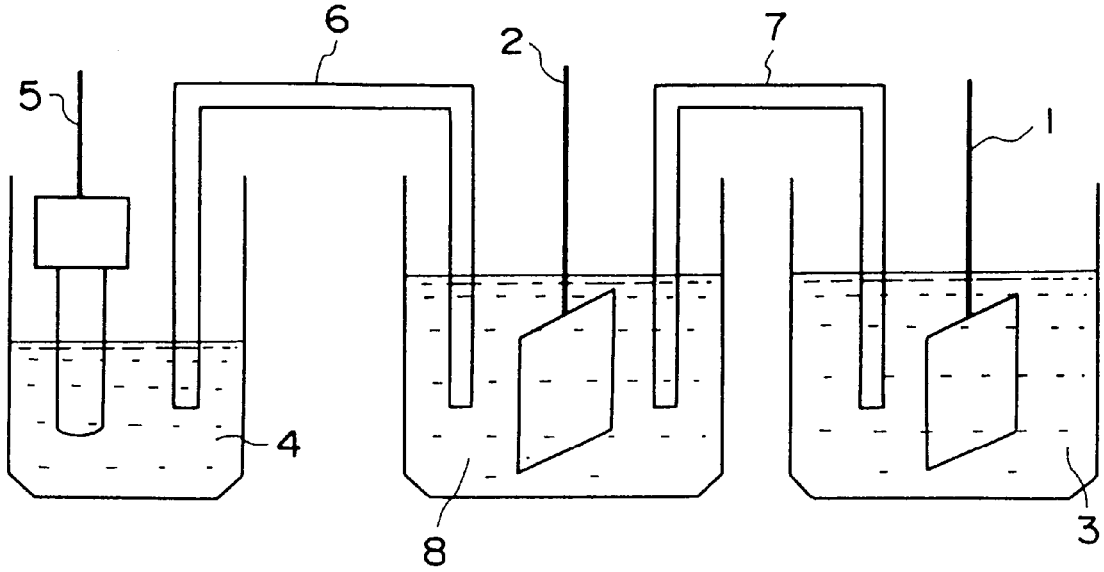
FIG. 9 is a schematic structural diagram of an apparatus used in another embodiment according to the present invention.

FIGS. 1 and 9 illustrate apparatuses for forming an image on an electrode by the method according to the present invention.

In the apparatus illustrated in FIG. 1, the first and second electrodes 1 and 2 are connected to a non-illustrated power supply, the electrodes 1 and 2 being platinum electrodes, and immersed into an aqueous solution 3 in which two sorts of dyes are dissolved. A saturation calomel electrode 5 as a reference electrode is immersed into a KCl saturated aqueous solution 4 electrically connected to aqueous solution 3 through a salt bridge 6. The saturation calomel electrode 5 is connected to the power supply through a non-illustrated potentiometer. If the aqueous solution 3 is, for example a mixture solution of Rose Bengal (red) and Brilliant Blue (blue) in this apparatus, when a voltage is applied between the platinum electrodes 1 and 2 so that the platinum electrode 1 is an anode, a purple electrodeposited film is formed on the platinum electrode 1. If the aqueous solution 3 is a mixture of Pro Jet Fast Yellow 2 (yellow) and Cathilon Pure Blue 5GH (blue), a green electrodeposited film is formed on the platinum electrode which has functioned as an anode, and a blue electrodeposited film is formed on the platinum electrode which has functioned as a cathode.

On the contrary, in the apparatus shown in FIG. 9, only the first electrode, i.e., the platinum electrode 1 is immersed into the aqueous solution 3, and the second electrode, that is, the plutonium electrode 2 is immersed into a KCl saturated aqueous solution 8 electrically connected to the aqueous solution 3 through a salt bridge 7. The platinum electrodes 1 and 2 are connected to a non-illustrated power supply. The saturation calomel electrode 5 as a reference electrode is immersed into the KCl saturated aqueous solution 4 electrically connected to a KCl saturated aqueous solution 8 through the salt bridge 6. The saturation calomel electrode 5 is connected to the power supply through a non-illustrated potentiometer. If the aqueous solution 3 is, for example a mixture solution of Rose Bengal (red) and Brilliant Blue (blue) in this apparatus, when a voltage is app lied between the platinum electrodes 1 and 2 so that the platinum electrode 1 is an anode, a purple electrodeposited film is formed on the platinum electrode 1. If the aqueous solution 3 is a mixture solution of Pro Jet Fast Yellow 2 (yellow) and Cathilon Pure Blue 5GH (blue), when a voltage is applied between the platinum electrodes 1 and 2 so that the platinum electrode 1 is an anode, a green electrodeposited film is formed on the platinum electrode 1. When a voltage is applied between the platinum electrodes 1 and 2 so that the platinum electrode 1 is a cathode, a blue electrodeposited film is formed on the platinum electrode 1. In this way, dye films of the two colors can be obtained from a single type of mixture solution merely by changing the polarity of the voltage applied to the electrodes.

In the apparatuses shown in FIGS. 1 and 9, the voltage applied between the electrodes 1 and 2 is usually from 0.6 to 3 V.

Figure 10:
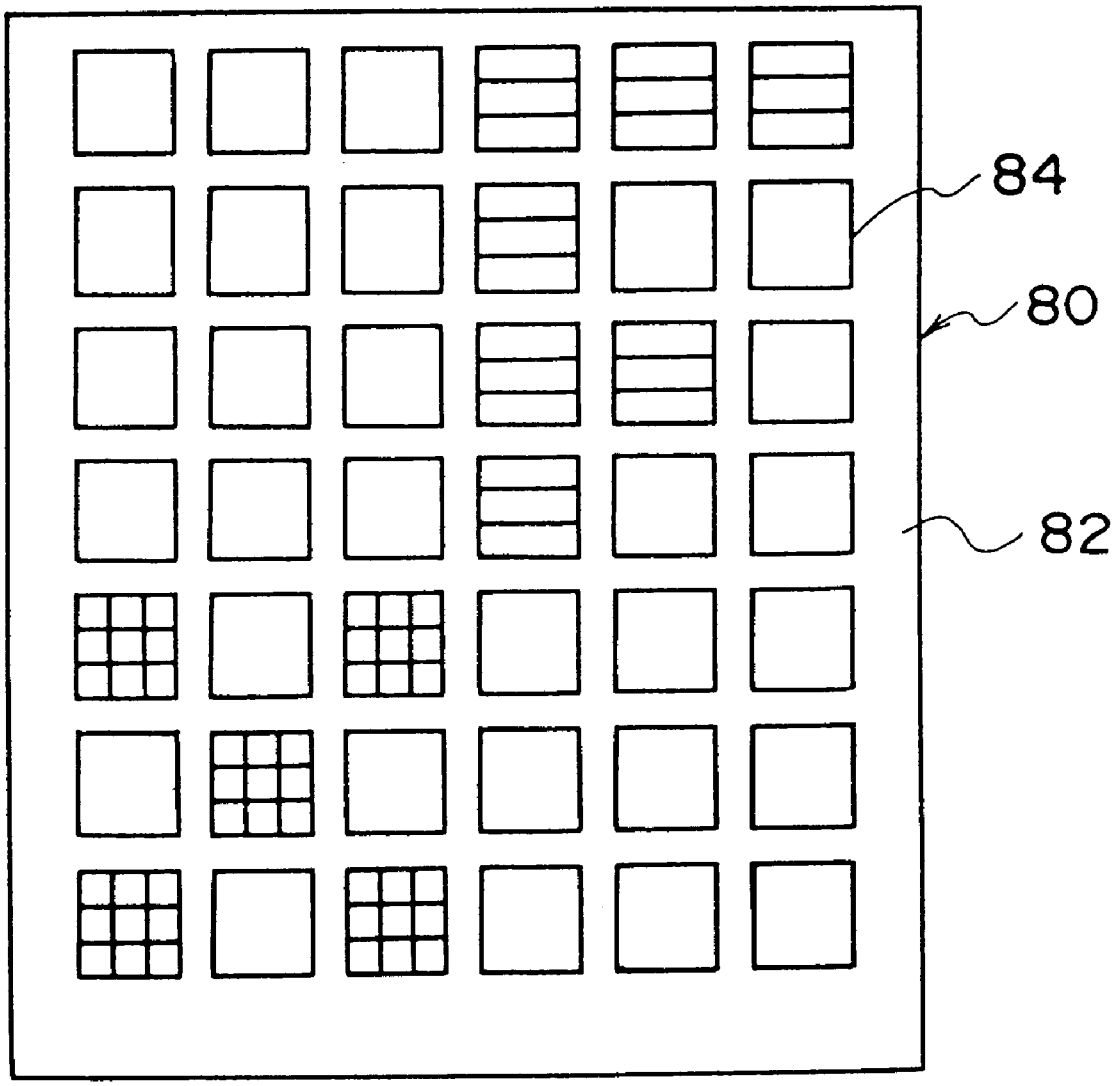
FIG. 10 shows a substrate in which electrodes in a matrix form are formed on a supporting member used in the present invention.

As shown by a substrate 80 in FIG. 10, in order to form an image having two colors on the same substrate, it is necessary to beforehand separate a surface area of a substrate into an area to which a positive voltage is to be applied and an area to which a negative voltage is to be applied. The electrode substrate 80 has a supporting body 82 composed of an insulator such as glass, and electrodes (e.g., platinum electrodes) 84 in a matrix on the supporting body 82. Preferably, the respective electrodes 84 are arranged and wired so that the desired positive or negative voltage is independently applied to the respective electrodes 84.

Figure 11:
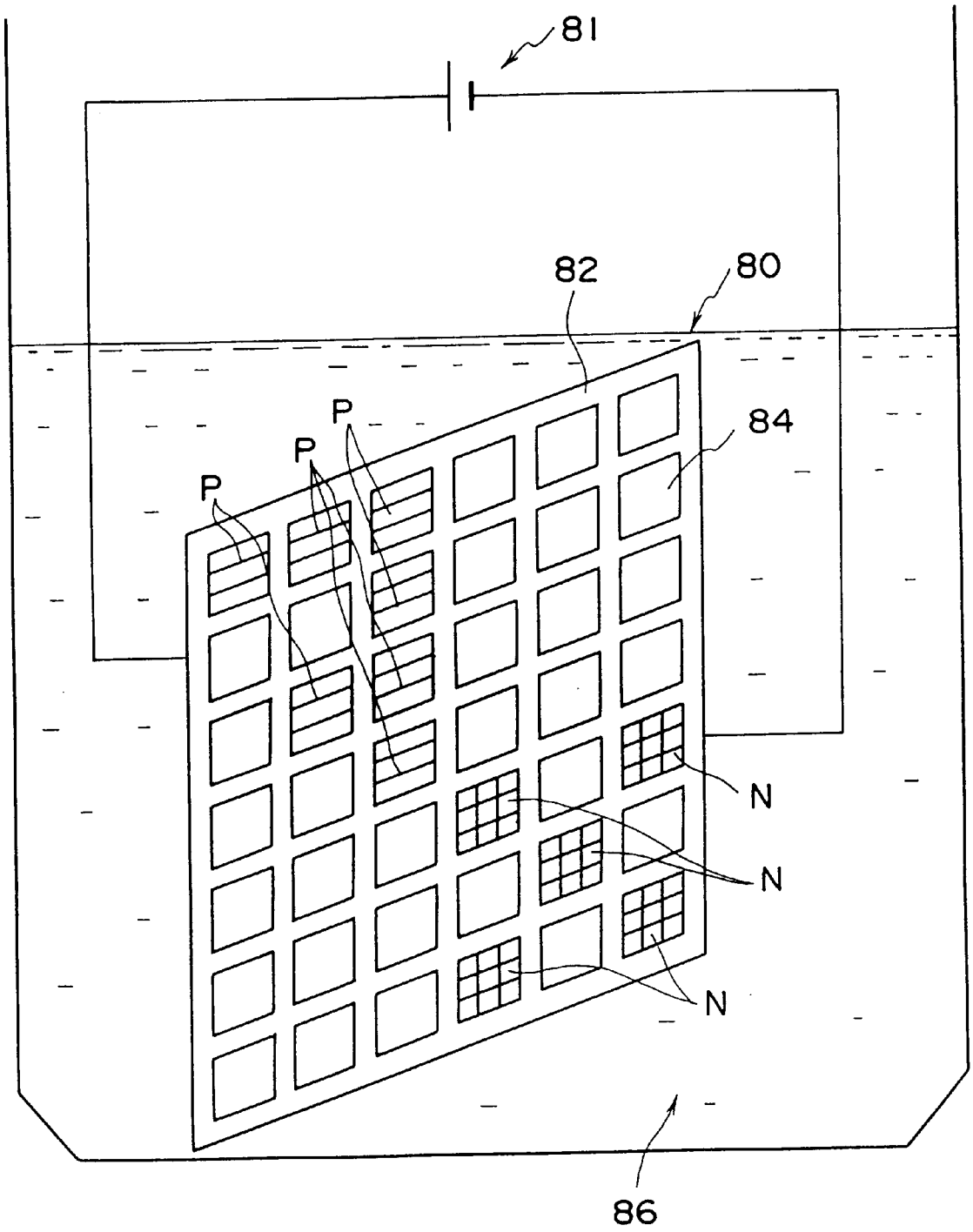
FIG. 11 is a schematic structural diagram of an apparatus for simultaneously forming an electrodeposited film having two colors on the substrate shown in FIG. 10.

The substrate 80 is used as shown in FIG. 11. That is, the two electrodes or areas on the substrate 80 are connected to each other through a direct current power supply 81, and the substrate 80 is immersed into an aqueous solution 86 in which two or more dyes having different polarities are dissolved. When a voltage is applied between the electrodes or the areas, two images are simultaneously formed, one of the images being a single color image composed of the single dye, and the other being a mixed color image composed of the two or more dyes. FIG. 11 illustrates the substrate 80 wherein the single color image is formed on areas P and the mixed color image is formed on areas N. This method uses the same principle that is used in the apparatus shown in FIG. 1, and the substrate 80 has the first and second electrodes.

Figure 12:
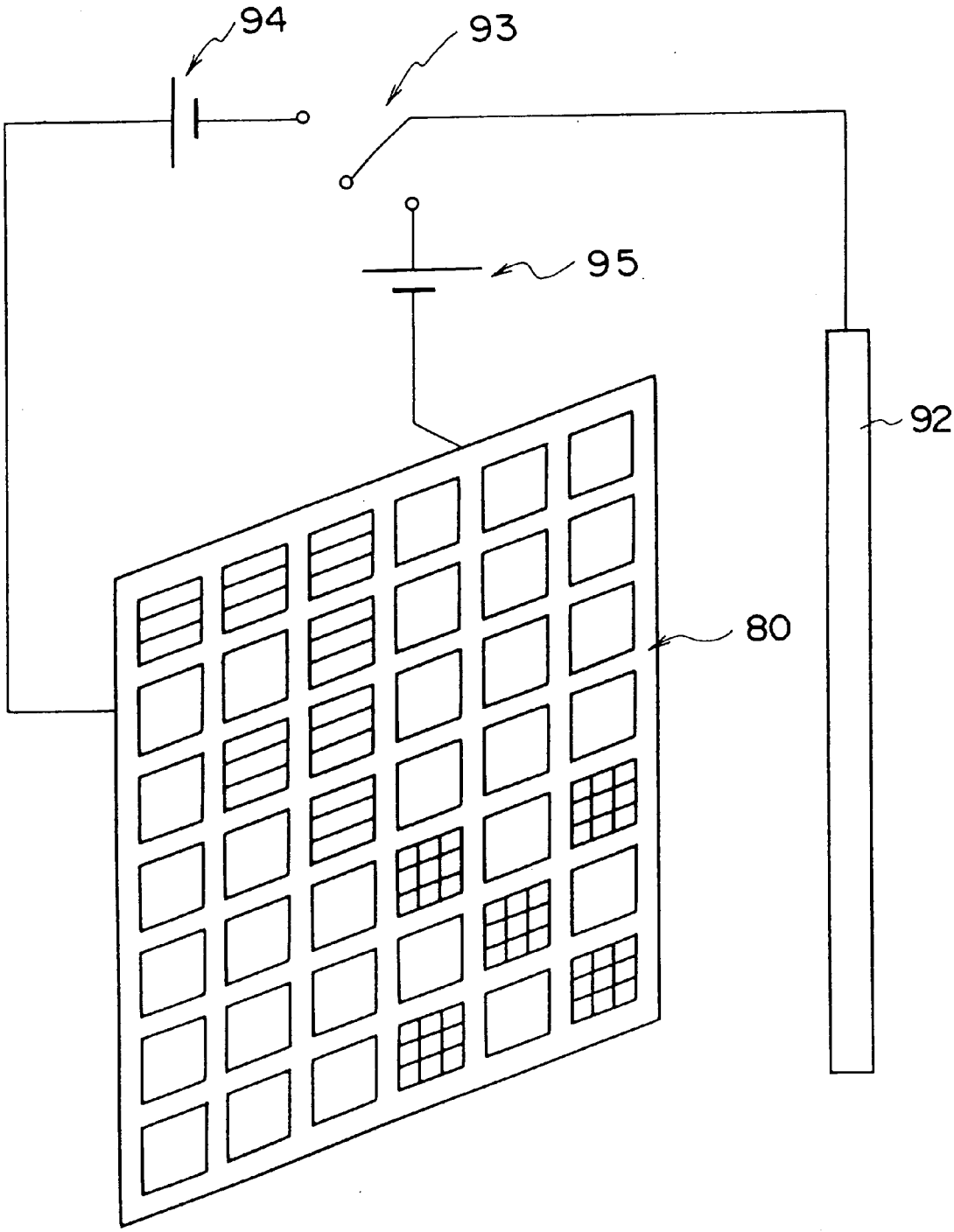
FIG. 12 is a schematic structural diagram of an apparatus for forming electrodeposited films having two colors one by one on the substrate shown in FIG. 10.

On the other hand, as shown in FIG. 12, a counter electrode 92, two direct current power supplies 94 and 95, and a switch 93 are prepared, and then the switch 93 is connected to the counter electrode 92, a nd power supplies 94 and 95 so that the counter electrode 92 can be connected to the negative side of the power supply 94 or the positive side of the power supply 95. The positive side of the power supply 94 and the negative side of the power supply 95 are connected to an arbitrary electrode or areas on the substrate 80, and then the substrate 80 is immersed into an aqueous solution in which two or more dyes having different polarities are dissolved. When the switch 93 is switched to the side of the power supply 94, a single color image or a mixed color image is formed on the arbitrary electrode or area on the substrate 80. When the switch 93 is switched to the side of the power supply 95, a mixed color image or a single color image is formed on the arbitrary electrode or area on the substrate 80. According to this method, a single color image and a mixed color image can be formed successively. In this case, the counter electrode 92 may be immersed into the aqueous solution, together with the substrate 80, or be immersed into an aqueous solution different from the aqueous solution into which the substrate 80 is immersed, by using a salt bridge. In the present method, the plurality of electrodes on the substrate 80 and the counter electrode 92 correspond to the first electrode and the second electrode, respectively.

According to the present invention, when a transparent substrate is used as the electrode in the above-mentioned apparatus, a color filter can be made wherein a single or a mixed color electrodeposited film is formed on the transparent substrate.

Figure 13:
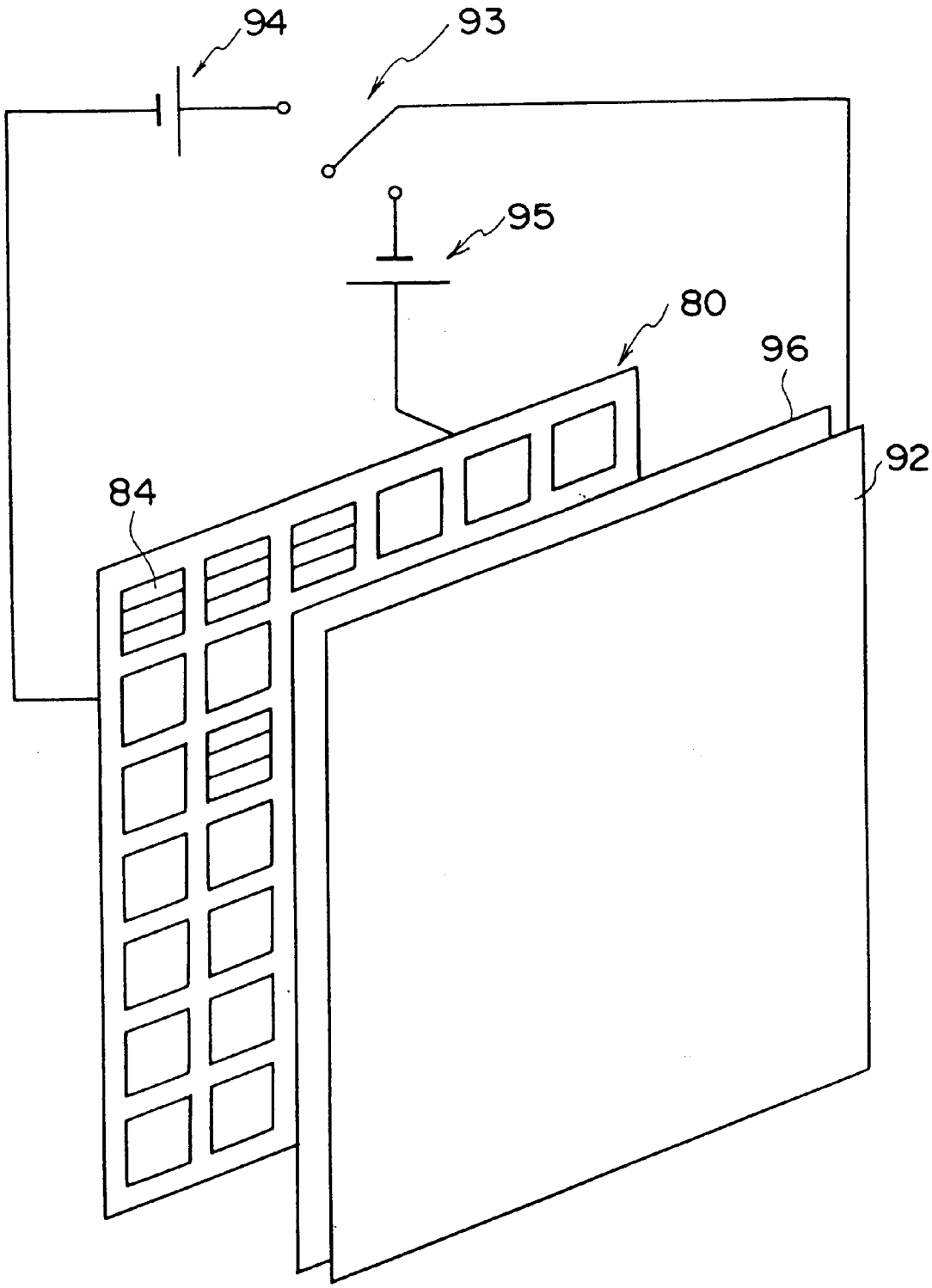
FIG. 13 is a schematic structural diagram of an apparatus for transferring the electrodeposited film having two colors formed on the substrate shown in FIG. 10.

In the present invention, an image formed on the electrode may be transferred onto an image receiving medium such as paper. Conventional methods for such transfer include using static electricity, pressure, adhesion, chemical bonding force, wettability, or the like to transfer an image formed on an electrode by a deposition phenomenon. According to the present invention, the two following methods are preferred for transferring an image formed on the electrode onto an image receiving medium. The first is a method of bringing the electrode having a formed image into contact with the image receiving medium and pressing them to transfer the image from the electrode to the medium. As shown in FIG. 13, the other is a method of arranging the substrate 80 having a formed image and the counter electrode 92 so that they face each other, arranging an image receiving medium 96 between the substrate 80 and the counter electrode 92, and applying a voltage between the electrode 84 and the counter electrode 92 so that the polarity of the electrode 84 on the substrate 80 will be opposite to the polarity at the time the image film was formed. In this method, the dye adhering to the electrode 84 is moved toward the counter electrode 92, to transfer the dye onto the image receiving medium 96 arranged between the electrode 84 and the counter electrode 92. When the image on the electrode has a difference in density, that is, light and shade, it is possible to forma transferred image corresponding to this image. The density of the transferred image may be adjusted by controlling, for example, the applied voltage during the formation of an image film and accordingly adjusting the density of the image on the electrode, as described above. Alternatively, the density of the transferred image may be adjusted by controlling at least one of the voltage, the electric charge and the electric current applied in the transfer, or the length of time for which they are applied.

The apparatus according to the present invention may have a means for removing any image-constituting particles remaining on the surface of the image supporting member (the remaining deposited dye particles) after the transfer. The method for removing the particles may be any known method including using a blade, a fur brush, an elastic roller, a cleaning web, or an air knife.

Figure 14:
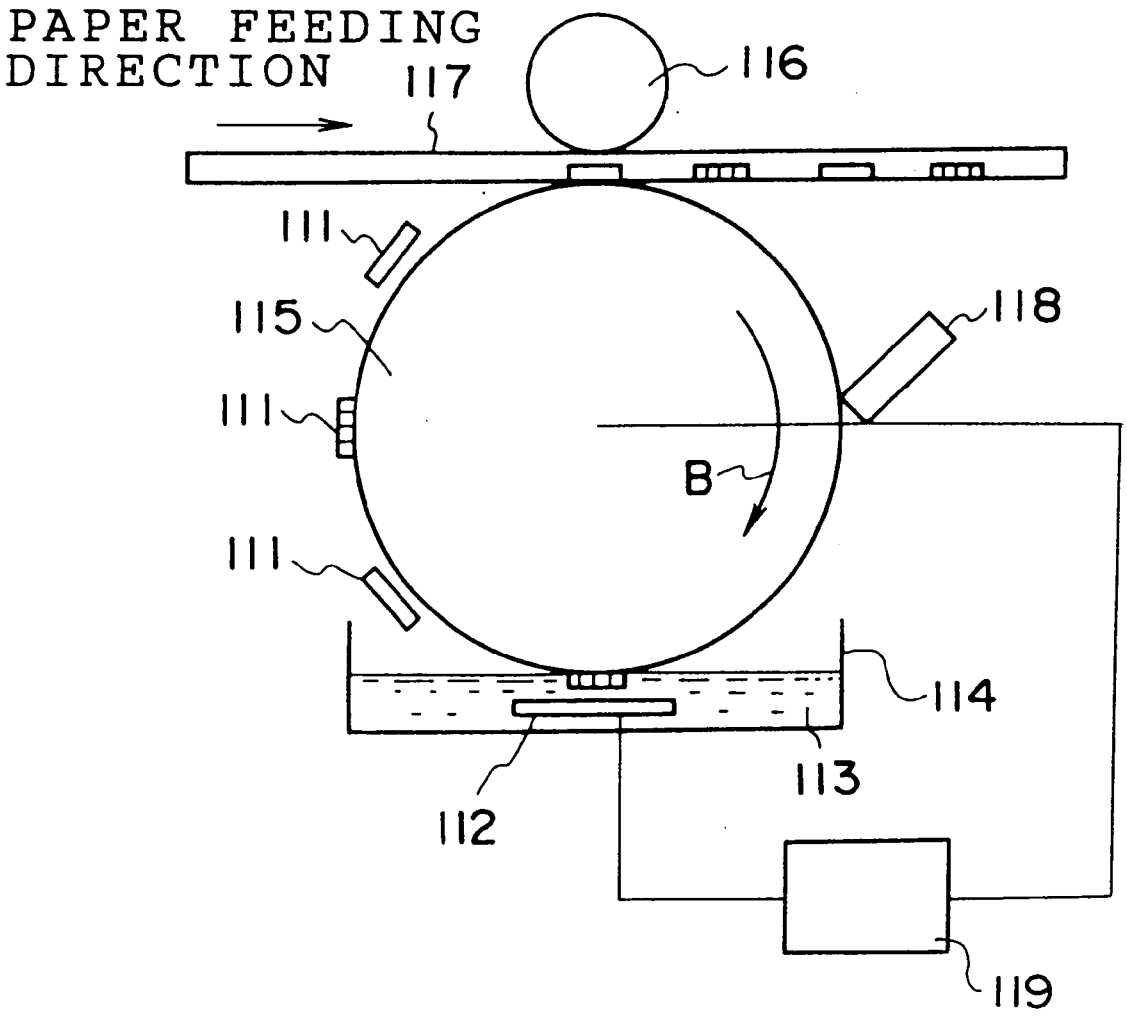
FIG. 14 is a schematic structural diagram of an apparatus which is used in the present invention and makes it possible to form an image and transfer the image.

FIG. 14 shows the schematic structure of a apparatus for forming an image on an electrode and transferring the formed image onto an image receiving medium by press. The apparatus shown in FIG. 14 has a roll 115 which can rotate along the direction shown by an arrow B. On the outer surface of the roll 115, a plurality of the first electrodes are formed which are divided into fine sections. Below the roll 115, a bath 114 containing a mixture solution 113 of dyes is arranged so that the electrodes positioned at the bottom of the roll 115 contact the mixture solution 113 or are immersed into the solution 113. The second electrode 112 is immersed into the bath 114. A transferring roll 116 is located over the roll 115. A paper 117 is fed between both the rolls 115 and 116. A cleaning blade 118 for removing dyes remaining on the roll 115 is provided at the downstream side, which is viewed from the transferring roll 116, of the rotation direction of the roll 115. The apparatus of FIG. 14 also has a controller 119 connected to the respective first electrodes arranged on the outer surface of the roll 115, and the second electrode 112. By control of the controller 119, a voltage is applied between the first electrodes on the roll 115 and the second electrode 112, so that the respective electrodes on the roll 115 will independently function as anodes or cathodes.

In this apparatus, an electrodeposited film 111 formed on the first electrodes on the roll 115 is transferred by pressing the transferring roll 116 onto the paper 117 fed between the film 111 and the transferring roll 116 when the first electrodes on which the film 111 is formed are shifted to the top of the roll 115.

Figure 15:
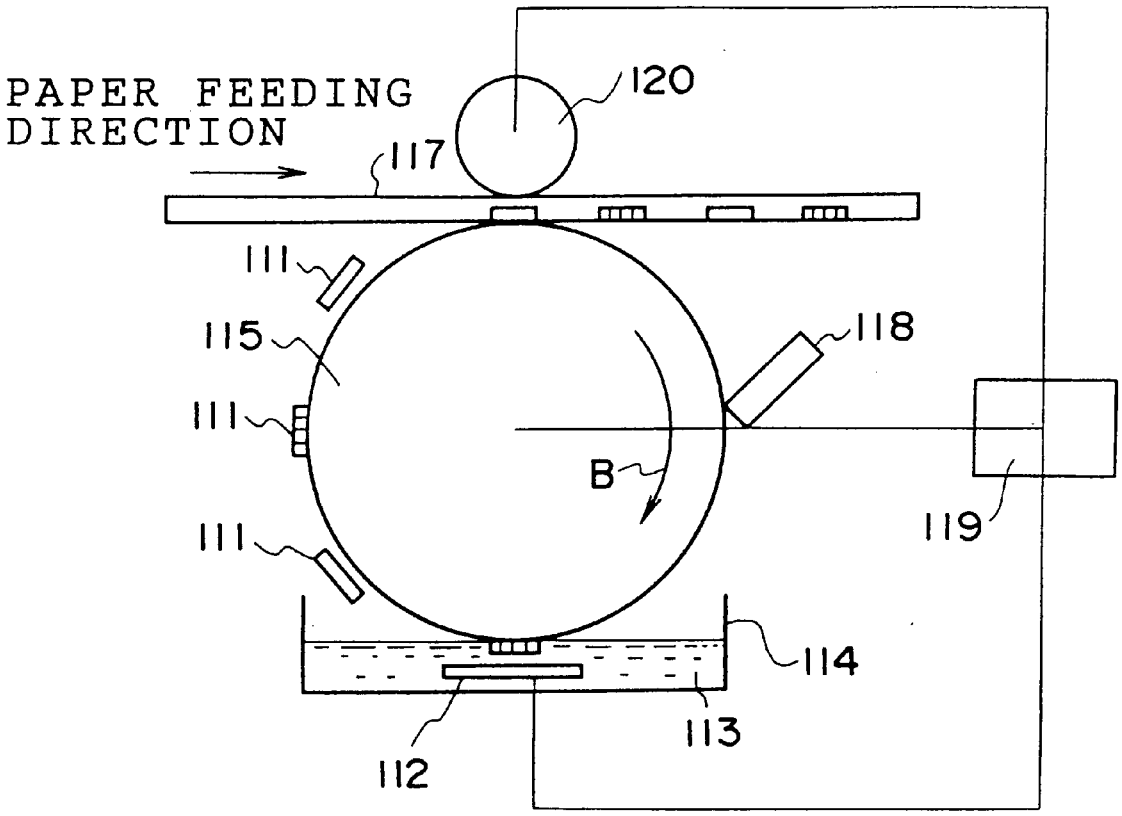
FIG. 15 is a schematic structural diagram of apparatus which is used in another aspect of the present invention and makes it possible to form an image and transfer the image.

FIG. 15 illustrates the schematic structure of a apparatus for forming an image on an electrode and then transferring the formed image onto an image receiving medium by applying a voltage. This apparatus is different from the apparatus shown in FIG. 14 in that a transferring roll 120 whose outer surface is composed of a conductive material is connected to the controller 119. In this apparatus, a voltage is applied between the electrode on which the electrodeposited film 111 and the transferring roll 120 so that the polarity of the electrodes will be opposite to its polarity at the time an image was formed. Thus, the electrodeposited film 111 is transferred onto the paper 117. In this apparatus, water having the desired pH value may be applied to the paper 117 during the transfer of the image.

As illustrated in FIGS. 14 and 15, images can be formed successively by arranging a plurality of the first electrodes on a roll.

To print a color image having three or more colors according to the present invention, an apparatus composed of combination of the apparatus shown in FIG. 14 or FIG. 15 with the same apparatus, or an apparatus having a roll, two baths containing two different sorts of mixture solutions, each of which contains two or more sorts of dyes, and a washing bath containing washing water may be used.

In the present invention, the raw materials of the first and second electrodes are not limited, and may be a metal, or an organic or inorganic semiconductor. An electrochemically stable material, such as a noble metal is preferred, for example, platinum or gold, or carbon. The transparent substrate for manufacturing a color filter may be one wherein an electrode made of, e.g., ITO or a conductive polymer, is formed on a transparent support made of, e.g., glass or a transparent film.

EXAMPLES

The following describes the present invention on the basis of specific examples.

Example 1

In the apparatus shown in FIG. 9, an aqueous solution (pH=7.2) was used which was a mixture of a 0.02 M Rose Bengal aqueous solution (red) and a 0.02 M BRILLIANT BLUE aqueous solution (blue). When voltage was applied between the platinum electrodes 1 and 2 for 30 seconds so that the potential difference between the saturation calomel electrode 5 and the platinum electrodes 1 and 2 was +1.0 V, a purple (a mixed color) thin film was formed on the platinum electrode 1. The platinum electrode 1 was withdrawn from the aqueous solution, and then, using the apparatus shown in FIG. 13 paper was interposed between the counter electrode 92 and the platinum electrode 1. When a voltage of −2.0 V was applied between these electrodes, an image composed of a purple thin film was formed on the paper.

This example demonstrates that an mixed color electrodeposited film can be formed from the mixture solution of a dye having a electrodeposition film forming ability and a dye having the same polarity as the first dye but not having this ability, and that the image can be transferred onto paper by applying a voltage to the first electrode and the counter electrode so that the polarity of the first electrode will be opposite to the polarity which it had during formation of the film.

Example 2

In the apparatus shown in FIG. 9, an aqueous solution (pH=7.2) was used which was a mixture of a 0.02 M Pro Jet Fast Yellow (manufactured by Zeneca Colour Marking Inc.) aqueous solution (yellow) and a 0.02 M Cathilon Pure Blue 5GH (manufactured by Hodogaya Chemical Co., Ltd.) aqueous solution (blue). When voltage was applied between the platinum electrodes 1 and 2 for 30 seconds so that the potential difference between the saturation calomel electrode 5 and the platinum electrodes 1 and 2 was become +2.0 V, a green (a mixed color) thin film was formed on the platinum electrode 1. The platinum electrode 1 was withdrawn from the aqueous solution, and then was brought into contact with paper under pressure so as to form an image composed of a green thin film on the paper.

In the apparatus shown in FIG. 9, voltage was applied between the platinum electrodes 1 and 2 for 30 seconds so that the potential difference between the saturation calomel electrode 5 and the platinum electrodes 1 and 2 was −2.0 V, a light yellow thin film was formed on the platinum electrode 1. After one minute, the color of the thin layer turned to blue. Subsequently, the platinum electrode 1 was withdrawn from the aqueous solution, and then was brought into contact with paper under pressure so as to form an image composed of a blue thin film on the paper.

This example demonstrates that images having two colors can be obtained from a mixture solution of two sorts of dyes having different polarities and that the images can be transferred onto paper by pressure.

Example 3

In the apparatus shown in FIG. 9, an aqueous solution was used which was a mixture of a 0.02 M Pro Jet Fast Yellow aqueous solution (yellow) and a 0.02 M Cathilon Pure Blue 5GH aqueous solution (blue). When voltage was applied between the platinum electrodes 1 and 2 for 30 seconds so that the potential difference between the saturation calomel electrode 5 and the platinum electrodes 1 and 2 was +2.0 V, a green (a mixed color) thin film was formed on the platinum electrode 1. The platinum electrode 1 was withdrawn from the aqueous solution, and then, using the apparatus shown in FIG. 13, paper was interposed between the counter electrode 92 and the platinum electrode 1. When a voltage of −2.0 V was applied between these electrodes, an image composed of a green thin film was formed on the paper.

In the apparatus shown in FIG. 9, volt age was applied between the platinum electrodes 1 and 2 for 30 seconds so that the potential difference between the saturation calomel electrode 5 and the platinum electrodes 1 and 2 was −2.0 V, a blue thin film was formed on the platinum electrode 1. The platinum electrode 1 was withdrawn from the aqueous solution, and then, using the apparatus shown in FIG. 13, paper was interposed between the counter electrode 92 and the platinum electrode 1. When a voltage of +2.0 V was applied between these electrodes for 30 seconds, an image composed of a blue thin film was formed on the paper.

This example demonstrates that images having two colors can be obtained from a mixture solution of two sorts of dyes having different polarities and that the image can be transferred on paper by applying a voltage between the first electrode and the counter electrode so that the polarity of the first electrode will be opposite to the polarity it had during formation of the film.

Example 4

In the apparatus shown in FIG. 9, in which an ITO electrode formed on a glass substrate was used as the first electrode, an aqueous solution was used which was a mixture of a 0.02 M Pro Jet Fast Yellow aqueous solution (yellow) and a 0.02 M Cathilon Pure Blue 5GH aqueous solution (blue). When voltage was applied between the ITO electrode and the platinum electrode 2 for 30 seconds so that the potential difference between the saturation calomel electrode 5 and the ITO electrode/platinum electrode 2 was +2.0

Figure 16:
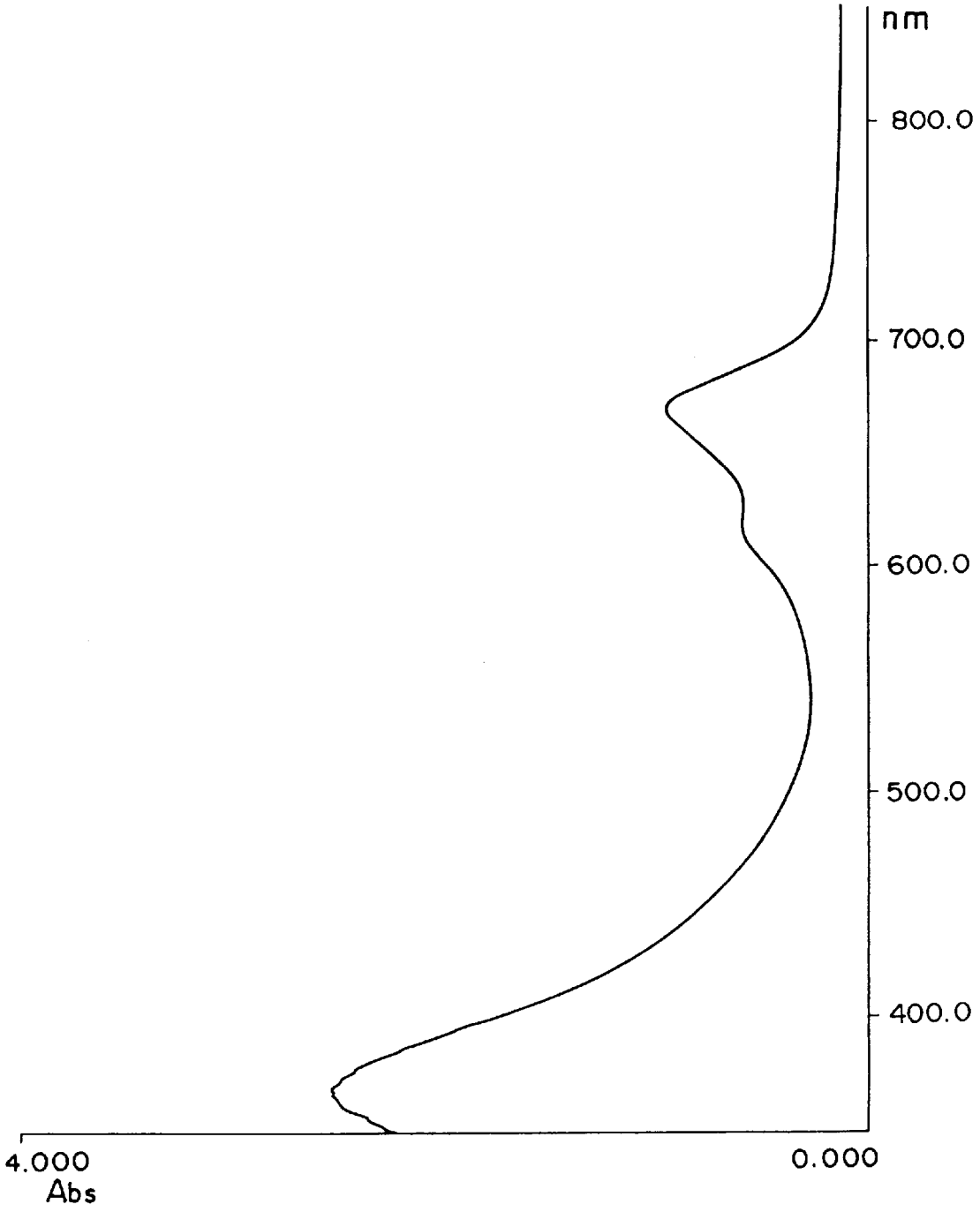
FIG. 16 shows an absorption spectrum of a mixed film of a color filter, being a mixed film which is composed of Pro Jet Fast Yellow 2 and Cathilion Pure Blue 5GH, formed on a transparent substrate.

V, a green (a mixed color) thin film was formed on the ITO electrode. The absorption spectrum of this film at this time is shown in FIG. 16.

Figure 17:
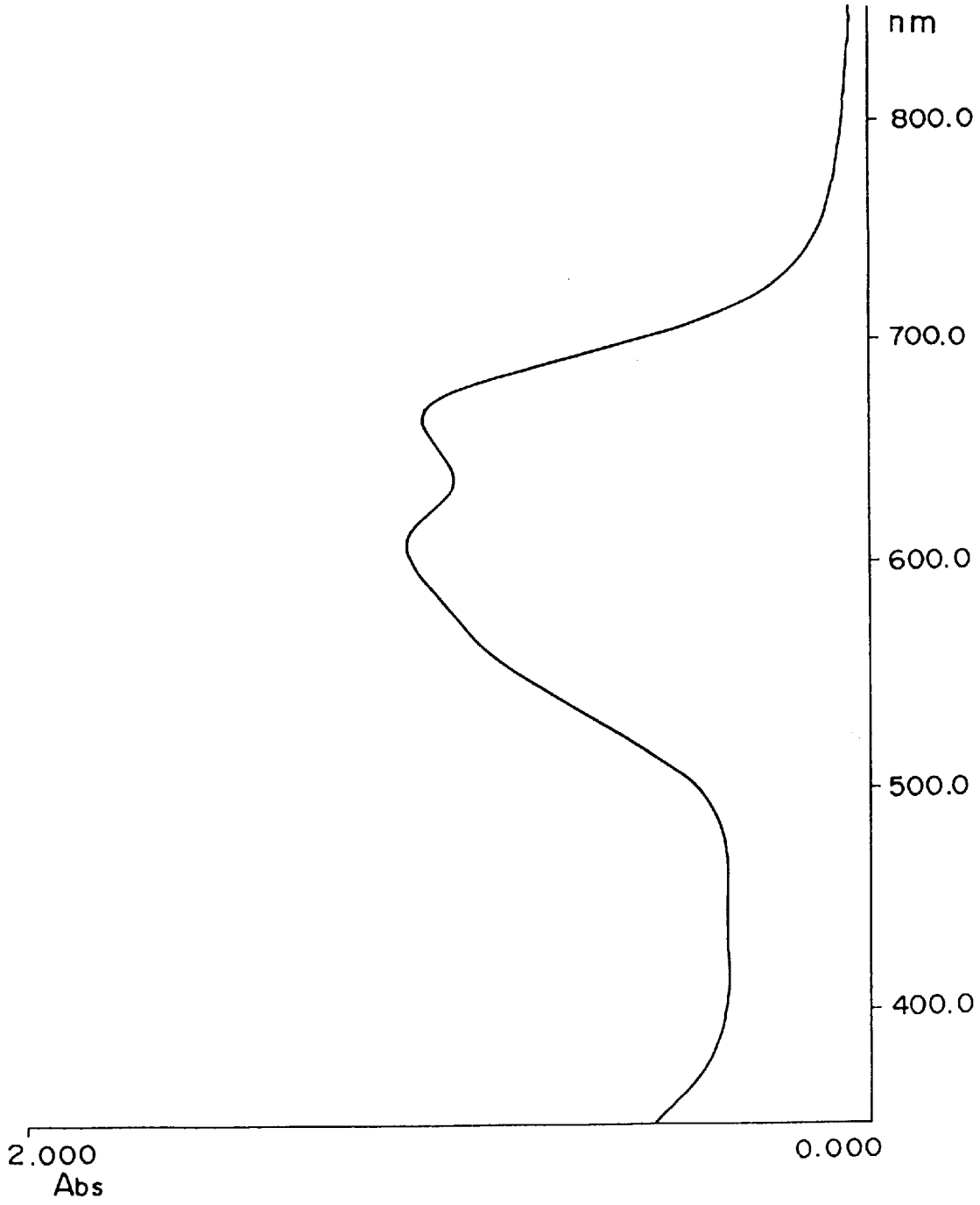
FIG. 17 shows an absorption spectrum of an electrodeposited film of a color filter, being an electrodeposited film which is composed of Cathilion Pure Blue 5GH formed on a transparent substrate.

When voltage was applied between the ITO electrode and the platinum electrodes 2 for 90 seconds so that the potential difference between the saturation calomel electrode 5 and the ITO electrode/platinum electrode 2 was −1.0 V, a blue thin film was formed on the ITO electrode. The absorption spectrum of this film at this time is shown in FIG. 17.

This example demonstrates that it is possible to form a dye film which can be used as a color filter on a transparent electrode. The absorption spectra clearly demonstrate that the resultant dye films are different depending on the polarity of the applied voltage.

Example 5

In the apparatus shown in FIG. 9, an aqueous solution was used which was a mixture of a 0.02 M Pro Jet Fast Yellow aqueous solution (yellow) and a 0.02 M Cathilon Pure Blue 5GH aqueous solution (blue). When voltage was applied between the saturation calomel electrode 5 and the platinum electrodes 1 and 2 for periods of 20 seconds, so that the potential difference between the saturation calomel electrode 5 and the platinum electrodes 1 and 2 rose from 0 V to +3.0 V at intervals of +0.5 V, green (a mixed color) thin films having different dye densities were formed on the platinum electrode 1 depending on the applied voltages. The platinum electrode 1 was withdrawn from the aqueous solution, and then was brought into contact with paper under pressure so as to form an image composed of a green thin film having an image density depending on the applied voltage on the paper.

Subsequently, in the apparatus shown in FIG. 9, when voltage was applied between the saturation calomel electrode 5 and the platinum electrodes 1, 2 for periods of 20 seconds, so that the potential difference between the saturation calomel electrode 5 and the platinum electrodes 1 and 2 rose from 0 V to −3.0 V at intervals of −0.5 V, blue thin films having different dye densities were formed on the platinum electrode 1 depending on the applied voltages. The platinum electrode 1 was withdrawn from the aqueous solution, and then was brought into contact with paper under pressure so as to form an image composed of a blue thin film having an image density depending on the applied voltage on the paper.

This example demonstrates that images having two colors can be obtained from a mixture solution of two sorts of dyes, and that the thickness of the dye films, that is, the density of the images is changed by the applied voltage to obtain transferred images having different image density.

Example 6

In the apparatus shown in FIG. 9, an aqueous solution was used which was a mixture of a 0.02 M Pro Jet Fast Yellow aqueous solution (yellow) and a 0.02 M Cathilon Pure Blue 5GH aqueous solution (blue). Voltage was applied between the saturation calomel electrode 5 and the platinum electrodes 1 and 2, so that the potential difference between the saturation calomel electrode 5 and the platinum electrodes 1 and 2 was +2.0 V. This was repeated while the period of time the voltage was applied was increased from 0 to 50 seconds at intervals of 10 seconds. As a result, green (a mixed color) thin films having different dye densities were formed on the platinum electrode 1 depending on the period the voltage was applied for. The platinum electrode 1 was withdrawn from the aqueous solution, and then was brought into contact with paper under pressure so as to form an image on the paper composed of a green thin film having an image density depending on the period the voltage was applied for.

Subsequently, in the apparatus shown in FIG. 9, a voltage was applied between the saturation calomel electrode 5 and the platinum electrodes 1 and 2, so that the potential difference between the saturation calomel electrode 5 and the platinum electrodes 1 and 2 was −2.0 V. This was repeated while the period of time the voltage was applied for was increased from 0 to 50 seconds at intervals of 10 seconds. As a result, blue thin films having different dye densities were formed on the platinum electrode 1 depending on the period the voltage was applied for. The platinum electrode 1 was withdrawn from the aqueous solution, and then was brought into contact with paper under pressure so as to form an image on the paper composed of a blue thin film having an image density depending on the period the voltage was applied for.

This example demonstrates that images having two colors can be obtained from a mixture solution of two types of dyes, and that the thickness of the dye films, that is, the density of the images is changed by the period of time the voltage is applied to obtain transferred images having different image densities.

Example 7

In the apparatus shown in FIG. 9, an aqueous solution was used which was a mixture of a 0.02 M Pro Jet Fast Yellow aqueous solution (yellow) and a 0.02 M Cathilon Pure Blue 5GH aqueous solution (blue). When a platinum electrode 1 was energized in 10 second periods, so that the electric current flowing through the platinum electrode 1 (whose surface area is 2 $cm^2$) increased from 0 mA to +10 mA at intervals of +1 mA, green (a mixed color) thin films having different dye densities were formed on the platinum electrode 1 dependent on the amperage of the energizing electric current. The platinum electrode 1 was withdrawn from the aqueous solution, and then was brought into contact with paper under pressure so as to form an image composed of a green thin film having an image density dependent on the amperage of the energizing electric current on the paper.

Subsequently, in the apparatus shown in FIG. 9, when a platinum electrode was energized in 10 second periods, so that the electric current flowing through the platinum electrode 1 increased from 0 mA to −10 mA at intervals of −1 mA, blue thin films having different dye densities were formed on the platinum electrode 1 dependent on the amperage of the energizing electric current. The platinum electrode 1 was withdrawn from the aqueous solution, and then was brought into contact with paper under pressure so as to form an image composed of a blue thin film having an image density dependent on the amperage of the energizing electric current on the paper.

This example demonstrates that images having two colors can be obtained from a mixture solution of two sorts of dyes, and that the thickness of the dye films, that is, the density of the images is changed by the amperage of the energizing electric current to obtain transferred images having different image densities.

Example 8

Figure 18:
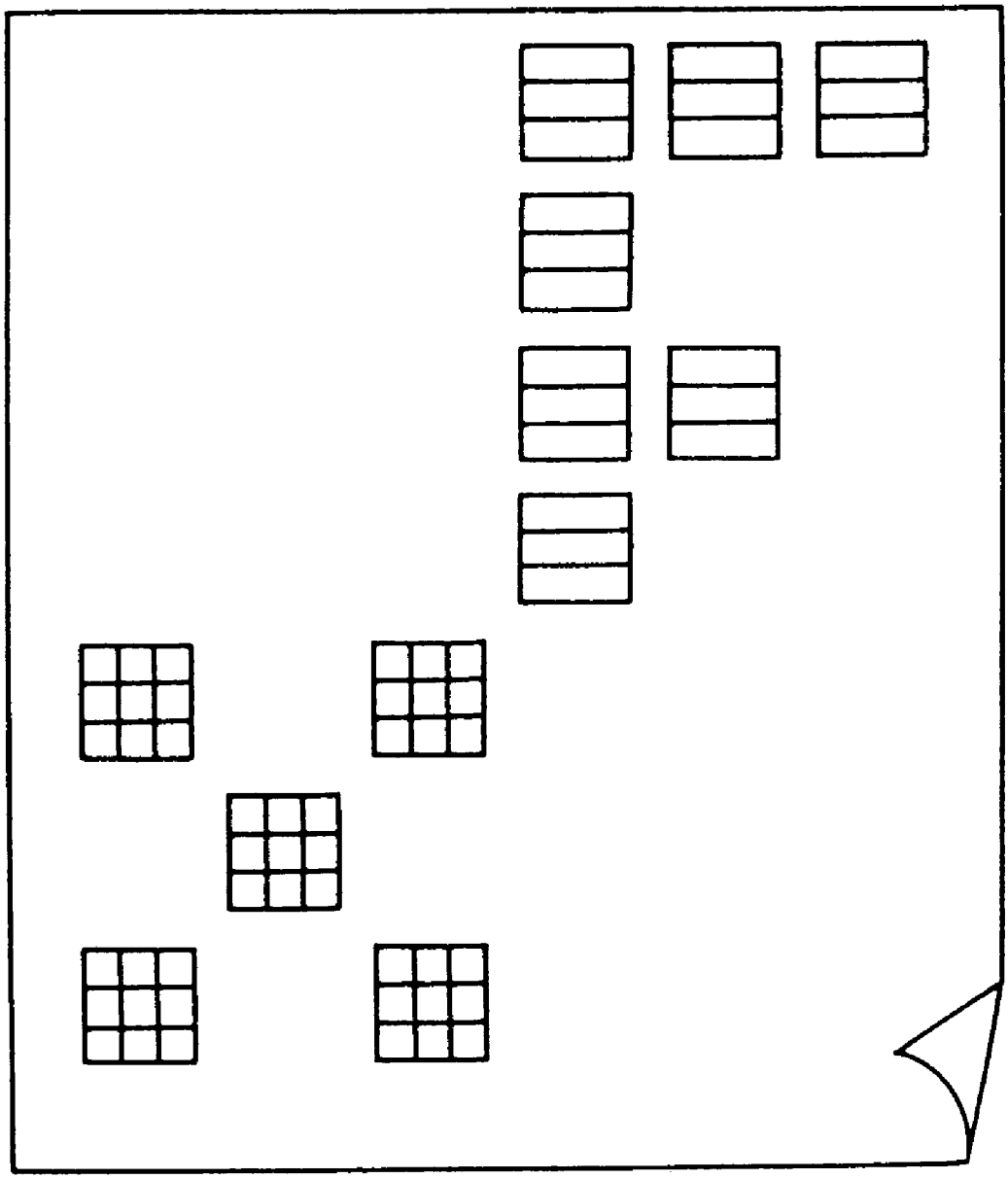
FIG. 18 illustrates a pattern having two colors obtained from the substrate shown in FIG. 11.

By sputtering, a substrate 80 shown in FIG. 10 was made which had a platinum electrode in a matrix form on a glass base. The electrode on the base was separated into an area for marking in a green color (the first electrode) and an area for making in a blue color (the second electrode) .AS shown in FIG. 11, the first and the second electrodes were connected to each other and then the electrodes were immersed into a mixture of a 0.02 M Pro Jet Fast Yellow (manufactured by Zeneca Colour Marking Inc.) aqueous solution (yellow) and a 0.02 M Cathilon Pure Blue 5GH (Hodogaya Chemical Co., Ltd.) aqueous solution (blue). When voltage of 4 V was applied between the electrodes of both areas for 20 seconds in such a way that the electrode of the area for marking in a green color would be an anode, a thin film having a green color (a mixed color) was formed on the anode. Alternatively, a thin film having a blue color was formed on the cathode. After that, the substrate 80 was brought into contact with paper under pressure so as to form at the same time a pattern on the paper having both green and blue colors, as shown in FIG. 18.

This example demonstrates that an image having two colors can be obtained from a mixture solution of two sorts of dyes by applying a voltage once and that an image having two colors can be obtained by a single transfer.

What is claimed is:

1. An image forming method comprising the step of applying a voltage between a first electrode and a second electrode, said first electrode being immersed into or brought into contact with an aqueous solution in which a group of two or more dyes, including at least one dye which is independently precipitated from the aqueous solution by an electrochemical reaction, are dissolved and coexist at a specified pH, and the second electrode cooperating with said first electrode in causing the electrochemical reaction, thereby forming on the first electrode a mixed color image which is composed of said group of dyes.

2. An image forming method according to claim 1, wherein said aqueous solution comprises an anionic dye having a carboxyl group and/or a cationic dye having an imino group.

3. An image forming method according to claim 1, wherein a dye represented by the following general formula (1) is used as the dye which can be independently precipitated from this aqueous solution by said electrochemical reaction, formula (1):

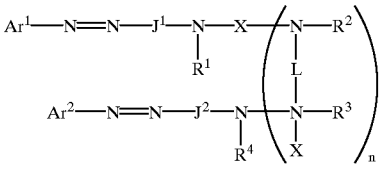

wherein $Ar^1$ and $Ar^2$ each independently represent an aryl or substituted aryl group; at least one of $Ar^1$ and $Ar^2$ has at least one substituent selected from a —COSH group and a —COOH group; $J^1$ and $J^2$ each independently represent a group represented by the formula (1), (2) or (3); L represents a bivalent organic linking group; X independently represents a carbonyl group or a group represented by the formula (4), (5) or (6); $R^1$ to $R^4$ each independently represent an arkyl or substituted alkyl group; and "n" is 0 or 1, (1)

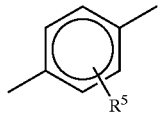

(2)

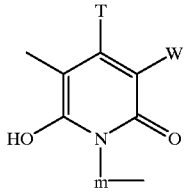

(3)

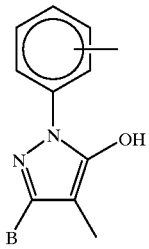

and wherein, in the formulas (1) to (3), $R^5$ represents a group selected from H, an alkyl group, a substituted alkyl group, an alkoxy group, a halogen atom, —CN, ureido, and —$NHCOR^6$ wherein $R^6$ represents H, an alkyl group, a substituted alkyl group, an aryl group, a substituted aryl group, an aralkyl group, or a substituted aralkyl group; T represents an alkyl group; W represents a group selected from the group consisting of H, —CN, —$CONR^{10}R^{11}$, a pyridinium group, and —COOH; m represents an alkylene chain having 2 to 8 carbon atoms; and B represents H, an alkyl group or —COOH in which $R^{10}$ and $R^{11}$ each independently represent an alkyl or substituted alkyl group, (4)

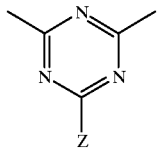

(5)

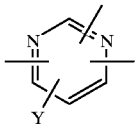

(6)

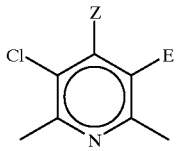

and wherein, in the formulae (4) to (6), Z represents —$OR^7$, —$Sr^7$, or —$NR^8R^9$, Y represents H, Cl, or CN; and E represents Cl or CN, in which each of $R^7$, $R^8$, and $R^9$ represents an alkyl or substituted alkyl group, an alkenyl or substituted alkenyl group, an aryl or substituted aryl group, an aralkyl or substituted aralkyl group; and $R^8$ and $R^9$ may constitute a 5 or 6-membered ring together with a bonded N atom.

4. An image forming method according to claim 1, wherein during image formation, the image density is controlled by controlling at least one of the applied voltage, the applied electric charge, and the applied electric current, and the period of time any one of the applied voltage, the applied electric charge and the applied electric current is applied for.

5. An image forming method according to claim 1, wherein during image formation, the image color is controlled by controlling at least one of the applied voltage, the applied electric charge, and the applied electric current, and the period of time any one of the applied voltage, the applied electric charge and the applied electric current is applied for.

6. An image forming method according to claim 1, further comprising transferring the image formed on said electrode onto an image receiving medium.

7. An image forming method according to claim 6, wherein said image is transferred onto said image receiving medium by bringing said electrode on which said image is formed into contact with said image receiving medium under pressure.

8. An image forming method according to claim 6, wherein said image is transferred onto said image receiving medium by bringing said electrode on which said image is formed into contact with said image receiving medium, and applying voltage between the first and second electrodes so that the polarity of the electrode on which said image is formed becomes opposite to the polarity that it had during formation of said image.

9. An image forming method according to claim 8, wherein during image formation, the density of said image is controlled by controlling at least one of the applied voltage, the applied electric charge, and the applied electric current, and the period of time any one of the applied voltage, the applied electric charge and the applied electric current is applied for.

10. An image forming method according to claim 1, wherein the first electrode is immersed into the aqueous solution.

11. An image forming method comprising the step of applying voltage between a first electrode and a second electrode, said first electrode being immersed into or brought into contact with an aqueous solution in which a group of two or more dyes having different polarities, and including at least one dye which is independently precipitated from the aqueous solution by the electrochemical reaction, are dissolved and coexist at a specified pH, and said second electrode cooperating with said first electrode in causing the electrochemical reaction, thereby forming, on at least the first electrode, a first mixed-color image composed of the group of dyes, or another mixed-color image composed of the group of dyes and whose colors are different from those of the first mixed-color image, or a single-color image composed of a single dye.

12. An image forming method according to claim 11, wherein said second electrode is immersed into or brought into contact with said aqueous solution and then voltage is applied between both electrodes, thereby forming the first mixed color image which is composed of said group of dyes on the first electrode, and forming another mixed color image, whose colors are different from those of the first mixed color image and is composed of said group of dyes, or a single color image which composed of a single dye, on the second electrode.

13. An image forming method according to claim 11, wherein said first and second electrodes are formed on a single substrate, to simultaneously form the first mixed color image which is composed of said group of dyes, and another mixed color image whose colors are different from those of the first mixed color image and is composed of said group of dyes, or a single color image which is composed of a single dye, on the substrate.

14. An image forming method according to claim 11, wherein a plurality of said first electrodes are formed on a single substrate, to form at least one mixed color image which is composed of said group of dyes, and another mixed color image whose colors are different from those of the first mixed color image and is composed of said group of dyes, or a single color image which is composed of a single dye, one by one, on said substrate.

15. An image forming method according to claim 11, wherein the first electrode is immersed into the aqueous solution.

16. A color filter making method, comprising the step of applying voltage between a transparent electrode and a counter electrode, said transparent electrode being immersed into or brought into contact with an aqueous solution in which a group of two or more dyes, containing at least one dye which is independently precipitated from this aqueous solution by an electrochemical reaction, are dissolved and coexist at a specified pH, and said counter electrode being provided to cooperate with said transparent electrode in causing the electrochemical reaction, thereby forming on said transparent electrode an electrodeposited film as a first mixed color image which is composed of said group of dyes, or another mixed color image whose colors are different to those of the first mixed color image and which is composed of said group of dyes, or a single color image which has a single color and is composed of a single dye.

17. A color filter making method according to claim 16, wherein the first electrode is immersed into the aqueous solution.

* * * * *